US010100724B2

(12) United States Patent
Kuki

(10) Patent No.: US 10,100,724 B2
(45) Date of Patent: Oct. 16, 2018

(54) VEHICLE, JET PROPELLED WATERCRAFT, AND ENGINE UNIT

(71) Applicant: YAMAHA HATSUDOKI KABUSHIKI KAISHA, Iwata-shi, Shizuoka (JP)

(72) Inventor: Yuusaku Kuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 355 days.

(21) Appl. No.: 14/723,494

(22) Filed: May 28, 2015

(65) Prior Publication Data

US 2016/0032877 A1 Feb. 4, 2016

(30) Foreign Application Priority Data

Aug. 1, 2014 (JP) ..... 2014-158128

(51) Int. Cl.

| | |
|---|---|
| ***F02B 61/04*** | (2006.01) |
| ***F02M 35/10*** | (2006.01) |
| ***F02M 35/16*** | (2006.01) |
| ***F02M 35/02*** | (2006.01) |

(52) U.S. Cl.

CPC ..... *F02B 61/045* (2013.01); *F02M 35/0204* (2013.01); *F02M 35/10249* (2013.01); *F02M 35/167* (2013.01)

(58) Field of Classification Search

CPC ..... F02M 35/10249; F02M 35/167
USPC ..... 123/184.21; 24/297; 411/45
See application file for complete search history.

(56) References Cited

U.S. PATENT DOCUMENTS

| | | | | |
|---|---|---|---|---|
| 9,366,311 | B2 * | 6/2016 | Gustavsson | F16F 1/3713 |
| 9,702,388 | B2 * | 7/2017 | Trojanowski | F16B 5/0642 |
| 2006/0137586 | A1 * | 6/2006 | Yoshiki | B63B 1/22 114/55.52 |
| 2007/0221182 | A1 * | 9/2007 | Takahashi | F02M 35/02 123/635 |
| 2007/0243775 | A1 * | 10/2007 | Osakabe | F02B 61/045 440/76 |
| 2007/0266988 | A1 * | 11/2007 | Ishizaka | F02M 35/10013 123/198 E |
| 2008/0035120 | A1 * | 2/2008 | Sone | F02M 37/103 123/509 |
| 2014/0299089 | A1 * | 10/2014 | Koenen | F04B 17/05 123/179.28 |

FOREIGN PATENT DOCUMENTS

JP 2007-285229 A 11/2007

* cited by examiner

*Primary Examiner* — Marguerite McMahon
*Assistant Examiner* — James Kim
(74) *Attorney, Agent, or Firm* — Keating and Bennett, LLP

(57) ABSTRACT

A jet propelled watercraft includes a watercraft body, an engine mounted on the watercraft body, an air intake box configured to supply air to the engine, and a mounting portion provided on the air intake box. The air intake box is disposed opposite to the engine. An electrical device is mounted on a front surface and a right surface of the air intake box, which are different from the surfaces of the air intake box that oppose the engine. The electrical device is removably mounted on the mounting portions without using an implement such as a tool.

15 Claims, 16 Drawing Sheets

VEHICLE, JET PROPELLED WATERCRAFT, AND ENGINE UNIT

BACKGROUND OF THE INVENTION

1. Field of the Invention

The present invention relates to a vehicle, a jet propelled watercraft, and an engine unit.

2. Description of the Related Art

An engine provided in an outboard motor disclosed in Japanese Patent Application Publication No. 2007-285229 (US2007/0243775A1) is provided with electrical components such as a controller, relays, and fuses. The electrical component is housed in an electrical component box. The electrical component box includes a box main body on which the electrical component is mounted and a lid body fixed to the box main body by screws. The electrical component box is fixed by bolts to a surge tank connected to an intake manifold of the engine.

To take out the electrical component described in Japanese Patent Application Publication No. 2007-285229 (US2007/0243775A1) for maintenance, it is necessary to remove the bolts that fix the electrical component box to the surge tank and the screws that fix the lid body to the box main body by use of an implement such as a tool. Also, to restore the electrical component to its original position, it is necessary to tighten the bolts and screws by use of the implement. Accordingly, because it takes time and effort to mount and remove the electrical component, there is a demand to reduce the time and effort.

Also, an improvement in overall maintainability with respect to the electrical component is demanded, without limitation to reducing the time and effort of mounting and removing the electrical component by use of an implement.

SUMMARY OF THE INVENTION

In order to overcome the previously unrecognized and unsolved challenges described above, a preferred embodiment of the present invention provides a vehicle including a body, an engine mounted on the body, an air intake box configured to supply air to the engine and opposed to the engine, and including an opposing surface opposed to the engine and a surface on which an electrical device is mounted that is different from the opposing surface, and a mounting portion provided on the air intake box and on which the electrical device is removably mounted without using an implement.

According to this arrangement, the electrical device is mounted on the surface of the air intake box that is different from the opposing surface opposed to the engine. Thus, at the time of maintenance, the electrical device is easily accessed without obstruction by the engine. Further, the electrical device is easily mountable and removable without using an implement on the mounting portion provided on the air intake box. Accordingly, the electrical device has improved maintainability.

In a preferred embodiment of the present invention, the vehicle is preferably a jet propelled watercraft including a watercraft body including an opening portion that opens upward and a jet pump configured to generate a jet thrust by sucking in and ejecting water by a driving force of the engine. In this case, the engine is accommodated in the watercraft body under the opening portion. Also, the electrical device is mounted on the surface that is different from both the opposing surface and a lower surface of the air intake box.

According to this arrangement, an opening portion that opens upward is provided in the watercraft body, and the engine is accommodated in the watercraft body under the opening portion. According to this arrangement, the electrical device is mounted on the surface that is different from both the opposing surface opposed to the engine and the lower surface of the air intake box. Thus, at the time of maintenance, the electrical device is easily accessed from the opening portion located thereabove. Accordingly, the electrical device has improved maintainability.

In a preferred embodiment of the present invention, the electrical device is preferably mounted on an upper portion of the air intake box.

According to this arrangement, at the time of maintenance, the electrical device is easily accessed from above. Accordingly, the electrical device has improved maintainability.

In a preferred embodiment of the present invention, the engine preferably includes a crankshaft configured to rotate about a crank axis, and the air intake box is preferably disposed on the crank axis.

According to this arrangement, even when the air intake box is disposed on the crank axis, the electrical device has improved maintainability.

In a preferred embodiment of the present invention, the air intake box is preferably mounted on the engine.

According to this arrangement, when the air intake box is mounted on the engine, the electrical device is located on the surface of the air intake box that is different from the opposing surface opposed to the engine. The electrical device is thus prevented from being thermally affected by the engine.

In a preferred embodiment of the present invention, the air intake box is preferably mounted on the engine via a vibration-proof member.

According to this arrangement, both vibrations of the air intake box and vibrations of the electrical device mounted on the air intake box are significantly reduced or prevented by the vibration-proof member.

In a preferred embodiment of the present invention, the mounting portion preferably has a convex or substantially convex shape projecting from a surface of the air intake box, and the electrical device preferably includes a bracket including a hole into which the mounting portion is inserted.

According to this arrangement, the electrical device is mounted on and removed from the mounting portion without using an implement, by inserting and pulling the convex or substantially convex shaped mounting portion into and out of the hole in the bracket of the electrical device.

In a preferred embodiment of the present invention, the mounting portion inserted into the hole preferably includes a distal end portion extending out of the hole, and a catching portion in the distal end portion is configured to be caught on a portion bordering the hole in the bracket.

According to this arrangement, the catching portion provided in the distal end portion is caught on the portion bordering the hole in the bracket with the mounting portion inserted into the hole of the bracket and the distal end portion of the mounting portion extending out of the hole. Because the mounting portion is prevented from unexpectedly coming out from the hole, a state in which the electrical device is mounted on the mounting portion is maintained.

In a preferred embodiment of the present invention, the bracket is preferably made of a vibration-proof material.

According to this arrangement, vibrations of the electrical device are significantly reduced or prevented by the bracket made of a vibration-proof material.

Another preferred embodiment of the present invention provides a jet propelled watercraft including a watercraft body, an engine that includes a crankshaft configured to rotate about a crank axis extending in a longitudinal direction of the watercraft body, and accommodated in the watercraft body, a jet pump configured to generate a jet thrust by sucking in and ejecting water by a driving force of the engine, and an air intake box configured to supply air to the engine, aligned with the engine on the crank axis, and including an opposing surface opposed to the engine and a surface on which an electrical device is mounted that is different from the opposing surface.

According to this arrangement, the electrical device is mounted on the surface of the air intake box that is different from the opposing surface opposed to the engine. Thus, at the time of maintenance, the electrical device is accessed without obstruction by the engine. Accordingly, the electrical device has improved maintainability.

In another preferred embodiment of the present invention, the watercraft body preferably includes an opening portion that opens upward, and the engine is preferably accommodated in the watercraft body under the opening portion. In this case, the electrical device is mounted on the surface that is different from both the opposing surface opposed to the engine and a lower surface of the air intake box.

According to this arrangement, the electrical device is mounted on the surface that is different from both the opposing surface opposed to the engine and the lower surface of the air intake box in a state where the engine is accommodated in the watercraft body under the opening portion. Thus, at the time of maintenance, the electrical device is easily accessed from the opening portion located thereabove. Accordingly, the electrical device has improved maintainability.

In another preferred embodiment of the present invention, the electrical device is preferably mounted on an upper portion of the air intake box.

According to this arrangement, at the time of maintenance, the electrical device is easily accessed from above. Accordingly, the electrical device has improved maintainability.

In another preferred embodiment of the present invention, the air intake box is preferably mounted on the engine via a vibration-proof member.

According to this arrangement, both vibrations of the air intake box and vibrations of the electrical device mounted on the air intake box are significantly reduced or prevented by the vibration-proof member.

In another preferred embodiment of the present invention, the air intake box preferably includes a mounting portion having a convex or substantially convex shape projecting from a surface of the air intake box, and the electrical device preferably includes a bracket including a hole into which the mounting portion is inserted, and is preferably removably mounted on the mounting portion.

According to this arrangement, the electrical device is mounted on and removed from the mounting portion without using an implement, by inserting and pulling the convex or substantially convex shaped mounting portion into and out of the hole in the bracket of the electrical device.

Still another preferred embodiment of the present invention provides an engine unit including an engine, an air intake box mounted on the engine via a vibration-proof member, configured to supply air to the engine, and including an opposing surface opposed to the engine, and a surface on which an electrical device is mounted and that is different from the opposing surface, a mounting portion provided on the air intake box and on which the electrical device is removably mounted, and an intake pipe that connects an intake-air outlet of the air intake box and an intake-air inlet of the engine to each other and at least a portion of which is made of a flexible material.

According to this arrangement, the electrical device is mounted on the surface of the air intake box that is different from the opposing surface opposed to the engine. Thus, at the time of maintenance, the electrical device is accessed without obstruction by the engine. Accordingly, the electrical device has improved maintainability.

Also, the air intake box is mounted on the engine via the vibration-proof member, and the flexible air intake pipe connects the intake-air outlet of the air intake box and the intake-air inlet of the engine to each other. Thus, both vibrations of the air intake box and vibrations of the electrical device mounted on the air intake box are significantly reduced or prevented.

Moreover, the electrical device is located on the surface of the air intake box that is different from the opposing surface opposed to the engine. The electrical device is thus prevented from being thermally affected by the engine.

In still another preferred embodiment of the present invention, the electrical device is preferably mounted on the surface that is different from both the opposing surface and a lower surface of the air intake box.

According to this arrangement, at the time of maintenance, the electrical device is easily accessed from above. Accordingly, the electrical device provides improved maintainability.

In still another preferred embodiment of the present invention, the engine preferably includes a crankshaft configured to rotate about a crank axis, and the air intake box is preferably disposed on the crank axis.

According to this arrangement, even when the air intake box is disposed on the crank axis, the electrical device provides improved maintainability.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings.

Figure 1:
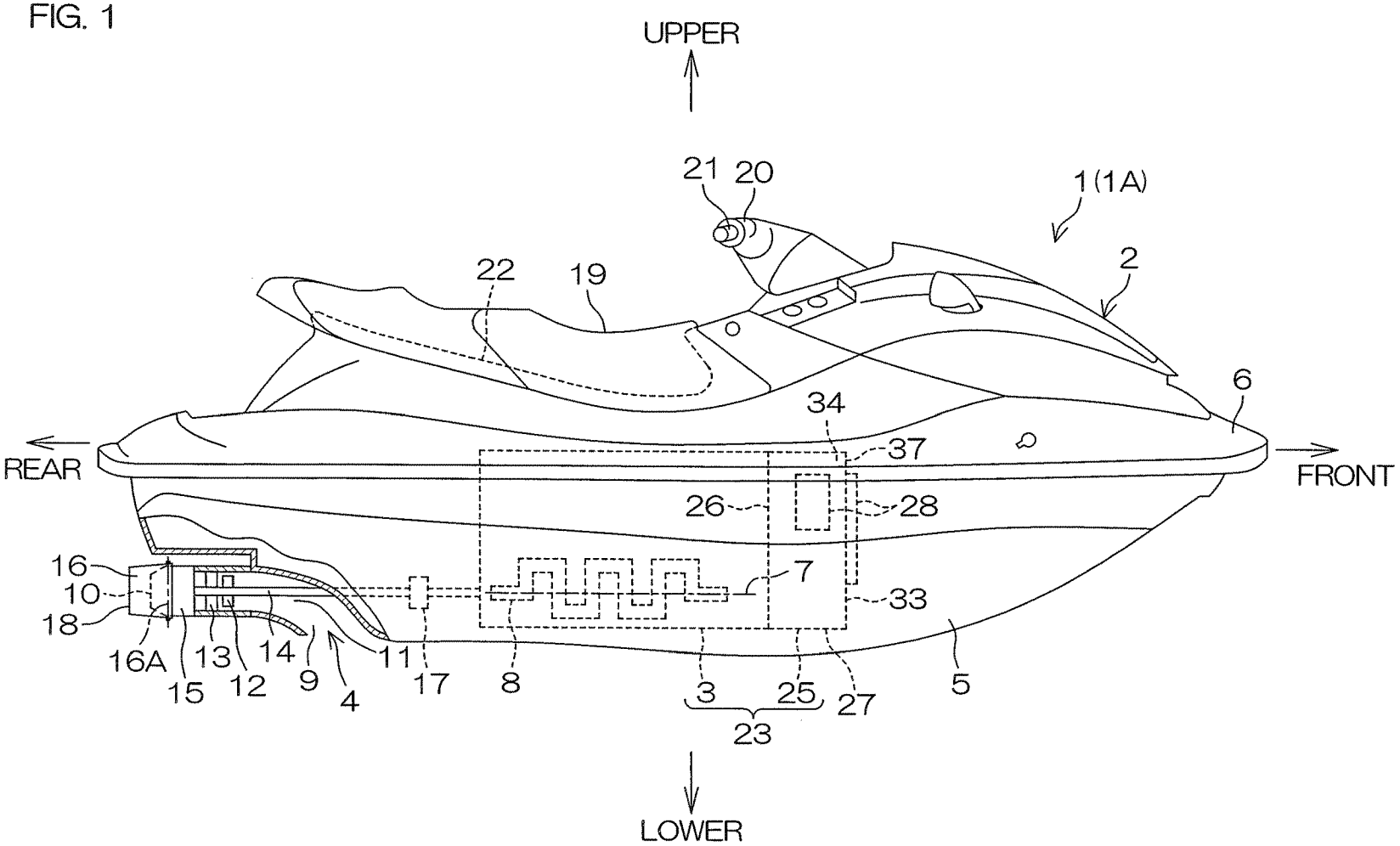
FIG. 1 is a schematic view of a vehicle according to a preferred embodiment of the present invention.

FIG. 1 is a schematic view of a vehicle 1 according to a preferred embodiment of the present invention. In the following, description will be given of an example where the vehicle 1 is a jet propelled watercraft 1A. Also, a right-left direction in FIG. 1 is defined as the front-rear direction of the vehicle 1, the right side in FIG. 1 is defined as the front of the vehicle 1, and the right-left direction of the vehicle 1 faces the traveling direction of the vehicle 1. Thus, the near side in a direction perpendicular to the sheet of FIG. 1 corresponds to the right side of the vehicle 1, and the far side in a direction perpendicular to the sheet of FIG. 1 corresponds to the left side of the vehicle 1.

As shown in FIG. 1, the jet propelled watercraft 1A includes a watercraft body 2, an engine 3 accommodated in an interior of the watercraft body 2, and a jet pump 4 mounted on a rear portion of the watercraft body 2.

The watercraft body 2 includes a hull 5 that defines the bottom of the watercraft and a deck 6 disposed above the hull 5. The watercraft body 2 is longer in the front-rear direction.

The engine 3 is disposed between the hull 5 and the deck 6 in an up-down direction. The engine 3 is disposed in front of the jet pump 4. The engine 3 is preferably an internal combustion engine including a crankshaft 8 that rotates about a crank axis 7 extending in the front-rear direction.

The jet pump 4 is driven by the engine 3. The jet pump 4 sucks in water from the watercraft bottom and ejects the water to the outside of the watercraft (exterior of the watercraft body 2) by a driving force of the engine 3. The jet pump 4 thus generates a jet thrust to propel the jet propelled watercraft 1A forward.

In detail, the jet pump 4 includes an intake 9 into which water outside the watercraft is sucked in, an outlet 10 from which the water sucked in from the intake 9 is ejected rearward, and a flow passage 11 that guides the water sucked into the intake 9 to the outlet 10. The jet pump 4 further includes an impeller 12 (rotor vane) and a stator vane 13 that are disposed in the flow passage 11, a driveshaft 14 coupled to the impeller 12, a nozzle 15 that defines the outlet 10, and a deflector 16 that deflects the direction of water ejected rearward from the nozzle 15 to the right and left.

The intake 9 opens at the watercraft bottom, and the outlet 10 opens rearward farther to the rear than the intake 9. The driveshaft 14 extends in the front-rear direction. A front end portion of the driveshaft 14 is disposed inside the watercraft, and a rear end portion of the driveshaft 14 is disposed in the flow passage 11. The front end portion of the driveshaft 14 is coupled to the crankshaft 8 of the engine 3 via a coupling 17 or the like. The impeller 12 is coupled to the driveshaft 14. The stator vane 13 is disposed behind the impeller 12, and the nozzle 15 is disposed behind the stator vane 13. The impeller 12 is rotatable about a central axis of the driveshaft 14 in the flow passage 11. The stator vane 13 is fixed with respect to the flow passage 11. The nozzle 15 is fixed to the watercraft body 2.

The impeller 12 is driven to rotate about the central axis of the driveshaft 14 together with the driveshaft 14 by the engine 3. When the impeller 12 is driven to rotate, water is sucked into the flow passage 11 from the intake 9 and is fed from the impeller 12 to the stator vane 13. Due to the water fed by the impeller 12 passing through the stator vane 13, a torsional water flow produced by rotation of the impeller 12 is reduced and the water flow is straightened. Thus, the flow-straightened water is fed from the stator vane 13 to the nozzle 15. The nozzle 15 preferably has a tubular shape extending in the front-rear direction, and the outlet 10 is defined by a rear end portion of the nozzle 15. The water fed to the nozzle 15 is thus jetted rearward from the outlet 10 of the rear end portion of the nozzle 15.

The deflector 16 extends rearward from the nozzle 15. The deflector 16 is coupled to the nozzle 15 and configured to rotate to the right and left about a deflector axis 16A extending in the up-down direction. The deflector 16 is hollow. The outlet 10 of the nozzle 15 is disposed in the deflector 16. The deflector 16 includes an ejection port 18 that opens rearward. The ejection port 18 is disposed behind the outlet 10. Water jetted rearward from the outlet 10 penetrates through an interior of the deflector 16 and is ejected rearward from the ejection port 18.

The jet propelled watercraft 1A includes a seat 19 on which a rider sits, a handle 20 that is operated to the right and left by the rider, and a throttle lever 21 mounted on the handle 20.

The seat 19 and the handle 20 are disposed over the watercraft body 2. The seat 19 and the handle 20 are supported by the watercraft body 2. The seat 19 and the handle 20 are disposed at a central portion of the jet propelled watercraft 1A in the right-left direction. The seat 19 is disposed behind the handle 20. The seat 19 is disposed on an upper portion of the watercraft body 2. An opening portion 22 that opens upward is provided in an upper portion of the watercraft body 2. The engine 3 is accommodated in the watercraft body 2 under the opening portion 22. The opening portion 22 is, in an ordinary state, blocked from above by the seat 19. When performing maintenance on the interior of the watercraft body 2, the opening portion 22 is opened by the seat 19 being removed. A user such as the rider accesses the interior of the watercraft body 2 by opening the opening portion 22.

An output of the engine 3 is adjusted by operation of the throttle lever 21 by the rider. The deflector 16 of the jet pump 4 turns to the right and left according to an operation of the handle 20. Thus, the direction of water that is ejected from the jet pump 4 is changed to the right and left by the operation of the handle 20. The jet propelled watercraft 1A is thus steered.

Figure 2:
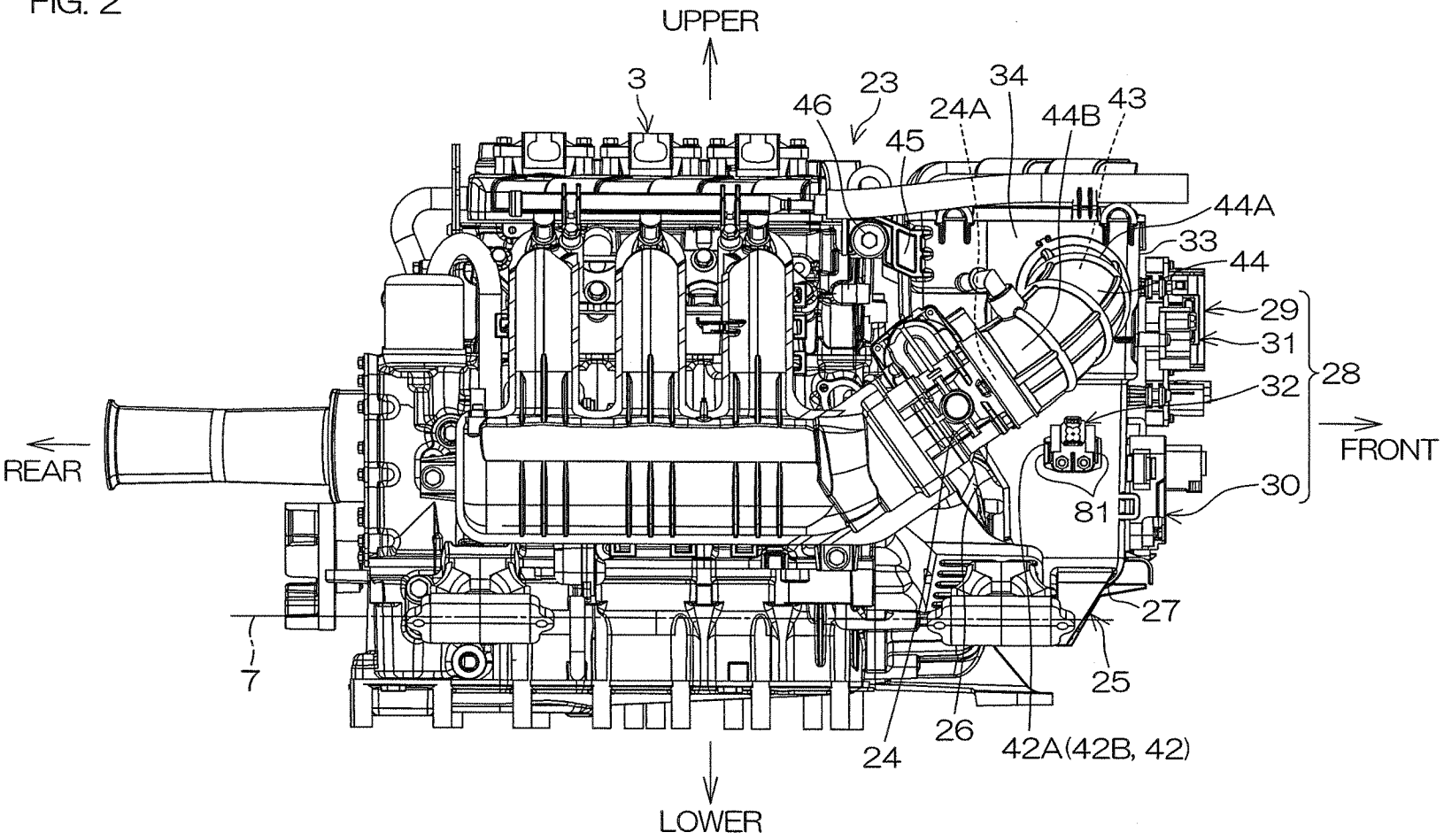
FIG. 2 is a side view of an engine unit provided in the vehicle.

FIG. 2 is a right side view of an engine unit 23 provided in the jet propelled watercraft 1A. The right side of FIG. 2 corresponds to the front of the jet propelled watercraft 1A.

As shown in FIG. 2, a throttle body 24 configured to adjust the amount of air to be supplied to the engine 3 is provided on a right surface of the engine 3. An intake-air inlet 24A configured to take in air is provided in a front surface of the throttle body 24. The intake-air inlet 24A faces obliquely upward.

The jet propelled watercraft 1A further includes an air intake box 25 configured to supply air to the engine 3 via the throttle body 24. The air intake box 25 is accommodated in the interior of the watercraft body 2 together with the engine 3. The air intake box 25 is disposed on the crank axis 7 extending in the front-rear direction, and disposed opposite to the engine 3 from the front so as to be aligned with the engine 3 on the crank axis 7. In the air intake box 25, a rear surface 26 is opposed to the engine 3. The air intake box 25 is mounted on the engine 3. The engine 3 and the air intake box 25 are preferably integral and together define an engine unit 23.

Figure 3:
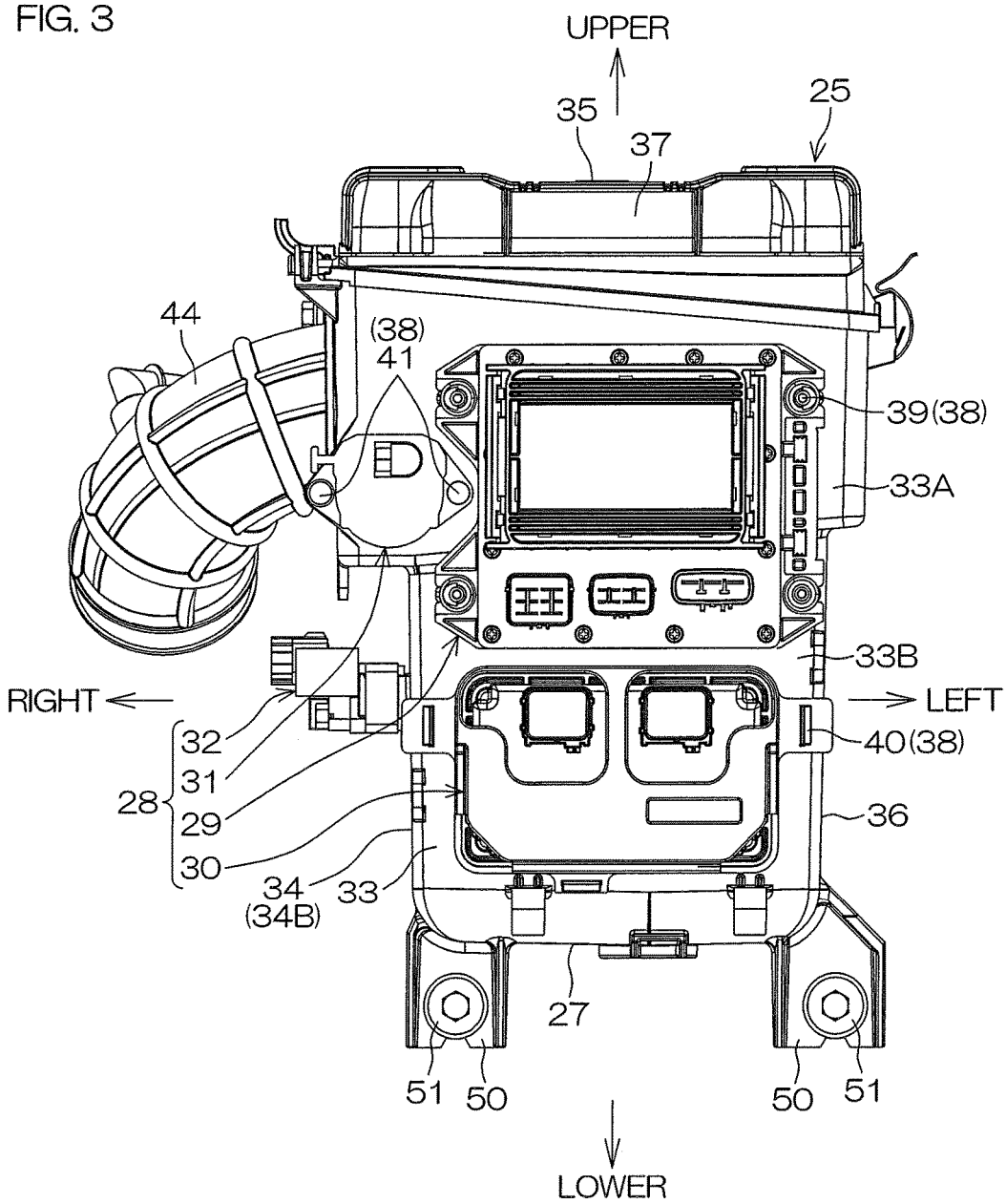
FIG. 3 is a front view of an air intake box included in the engine unit.

FIG. 3 is a front view of the air intake box 25. The right-left direction of FIG. 3 is reverse to the right-left direction of the air intake box 25.

As shown in FIG. 3, the jet propelled watercraft 1A includes electrical devices 28 that are mounted on a surface of the air intake box 25 that is different from both the rear surface 26 and a lower surface 27. In the present preferred embodiment, a fuse box 29, an ECU 30 (Electronic Control Unit), an overturn switch 31, and a starter unit 32 are non-limiting examples of the electrical devices 28.

The fuse box 29 stores a plurality of fuses inserted in an electric circuit inside the jet propelled watercraft 1A. The ECU 30 is an electrical component configured or programmed to control the electrical devices provided in the jet propelled watercraft 1A. The overturn switch 31 is an electrical component configured to detect an overturn (upset) of the jet propelled watercraft 1A. The starter unit 32 is an electrical component configured to start the engine 3.

The fuse box 29, the ECU 30, and the overturn switch 31 are preferably mounted on a front surface 33 of the air intake box 25. The starter unit 32 is preferably mounted on a right surface 34 of the air intake box 25.

Figure 4:
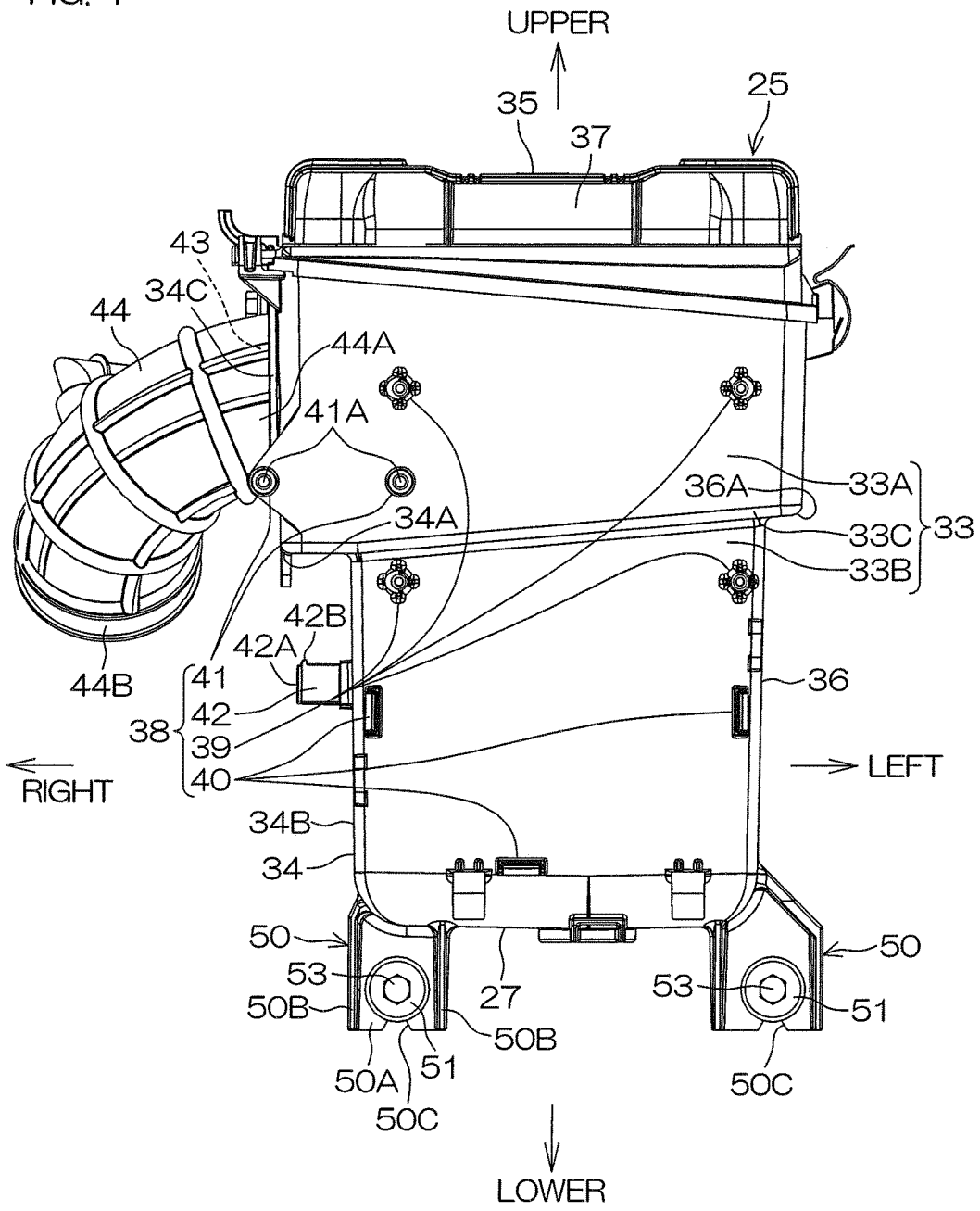
FIG. 4 is a front view of the air intake box from which electrical devices have been removed.
Figure 5:
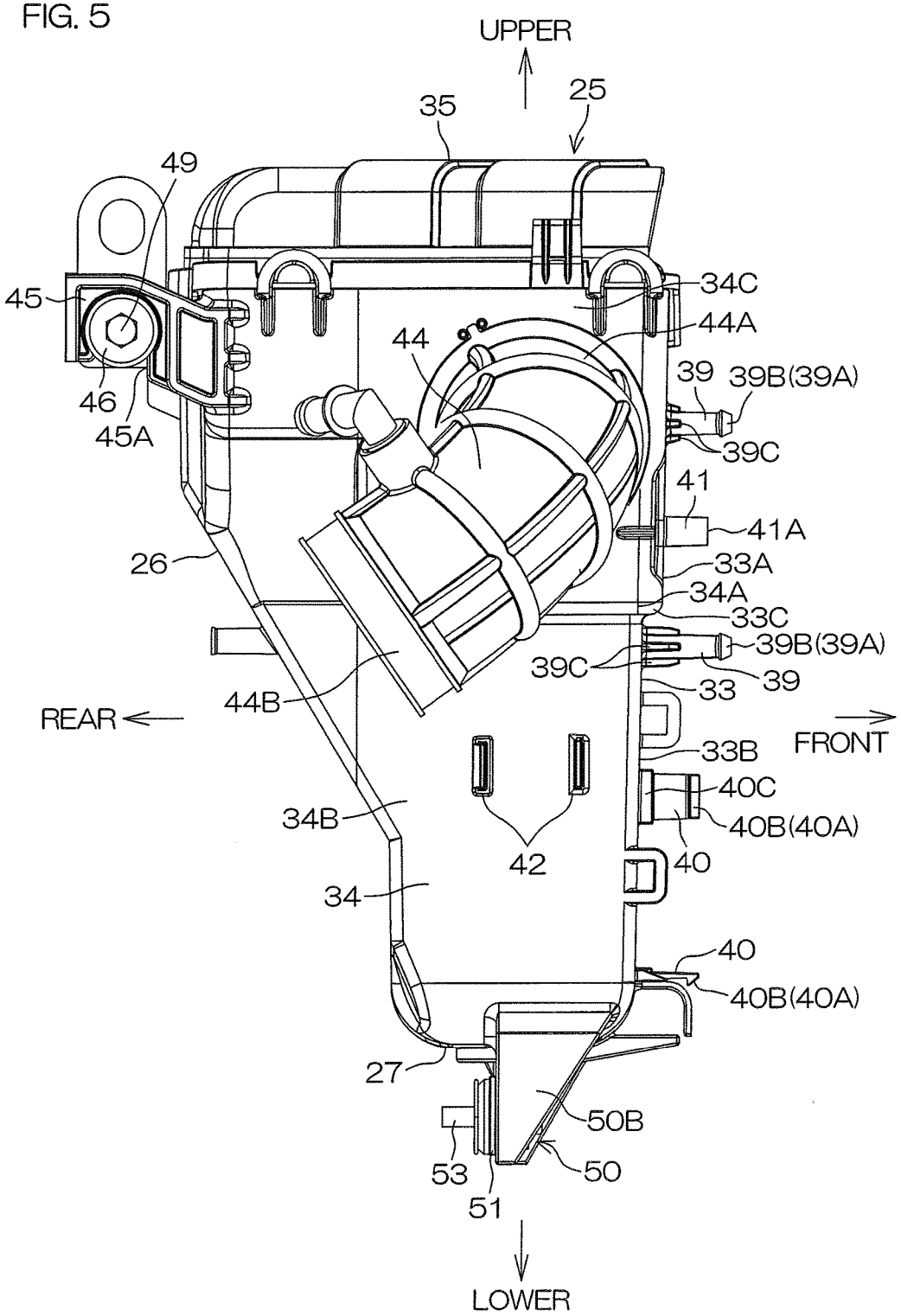
FIG. 5 is a side view of the air intake box from which electrical devices have been removed.

FIG. 4 is a front view of the air intake box 25 from which the electrical devices 28 have been removed. FIG. 5 is a right side view of the air intake box 25 from which the electrical devices 28 have been removed.

As shown in FIG. 4, the air intake box 25 is preferably made of a resin and has a hollow body. The air intake box 25 includes a built-in filter configured to clean air. The air intake box 25 includes an upper surface 35 and a left surface 36, in addition to the rear surface 26, the lower surface 27, the front surface 33, and the right surface 34 described above.

The front surface 33 includes an upper region 33A that occupies substantially an upper half thereof and a lower region 33B that occupies substantially a lower half thereof. The upper region 33A and the lower region 33B both preferably have a rectangular or substantially rectangular shape that are flat in the up-down and right-left directions, and the lower region 33B is smaller than the upper region 33A in the right-left direction. The lower region 33B is shifted to the rear farther than the upper region 33A (refer to FIG. 5). Thus, the front surface 33 includes a step 33C at a boundary between the upper region 33A and the lower region 33B. An intake-air inlet 37 that is slender in the right-left direction is provided in an upper end portion of the upper region 33A. The intake-air inlet 37 communicates with an interior of the air intake box 25. Air taken into the air intake box 25 from the intake-air inlet 37 is cleaned by the built-in filter of the air intake box 25.

A plurality of mounting portions 38 on which the electrical devices 28 are removably mounted are provided on the air intake box 25. Each of the mounting portions 38 preferably has a convex shape projecting from the surface of the air intake box 25.

The mounting portions 38 include first mounting portions 39 on which the fuse box 29 is mounted, second mounting portions 40 on which the ECU 30 is mounted, third mounting portions 41 on which the overturn switch 31 is mounted, and fourth mounting portions 42 on which the starter unit 32 is mounted. The first mounting portions 39, the second mounting portions 40, and the third mounting portions 41 are provided on the front surface 33, and the fourth mounting portions 42 are provided on the right surface 34.

The first mounting portions 39 are provided one each across a space therebetween in the right-left direction at positions lower than the intake-air inlet 37 in the upper region 33A. Also, the first mounting portions 39 are also provided, in an upper end portion of the lower region 33B, one each across a space therebetween in the right-left direction. Thus, a total of four first mounting portions 39 are provided. The right first mounting portion 39 in the upper region 33A and the right first mounting portion 39 in the lower region 33B are preferably located at the same position in the right-left direction, and the left first mounting portion 39 in the upper region 33A and the left first mounting portion 39 in the lower region 33B are preferably located at the same position in the right-left direction.

As shown in FIG. 5, each of the first mounting portions 39 preferably has a tubular shape extending in the front-rear direction. The first mounting portion 39 includes a distal end portion 39A at its front end portion. In all first mounting portions 39, the distal end portions 39A are preferably at substantially the same position in the front-rear direction. In the distal end portion 39A, a catching portion 39B is provided that is one step thicker than a portion farther to the rear than the distal end portion 39A in the first mounting portion 39. The catching portion 39B includes an outer peripheral surface that is tapered toward the front. The catching portion 39B may extend across the entire circumferential region of the distal end portion 39A, or may extend only partially across the circumferential region. A first mounting portion 39 on which no catching portion 39B is provided may be included among the plurality of first mounting portions 39.

Positioning portions 39C configured to position the fuse box 29 are provided at a rear end portion of the first mounting portion 39. The positioning portions 39C include ribs extending in the front-rear direction. A plurality of positioning portions 39C are disposed at intervals in the circumferential direction of an outer peripheral surface of the first mounting portion 39.

As shown in FIG. 4, the second mounting portions 40 are disposed one each across a space therebetween in the right-left direction at positions that are at the center or approximate center in the up-down direction in the lower region 33B. Of the two second mounting portions 40 aligned in the right-left direction, the right second mounting portion 40 is located in a right end portion of the lower region 33B, and the left second mounting portion 40 is located in a left end portion of the lower region 33B. Also, another second mounting portion 40 is provided at the center or approximate center in the right-left direction in a lower end portion of the lower region 33B. Thus, a total of three second mounting portions 40 preferably are provided, for example.

Each of the second mounting portions 40 preferably have a plate shape extending in the front-rear direction. The two second mounting portions 40 aligned in the right-left direction are thin in the right-left direction. The right-left direction corresponds to the thickness direction of the two second mounting portions 40. The second mounting portion 40 provided in the lower end portion of the lower region 33B is thin in the up-down direction. The up-down direction corresponds to the thickness direction of the second mounting portion 40.

As shown in FIG. 5, each of the second mounting portions 40 includes a distal end portion 40A at its front end portion. In all second mounting portions 40, the positions of the distal end portions 40A are the same or substantially the same in the front-rear direction. In the distal end portion 40A, a catching portion 40B is provided that is bent into a hook shape in the thickness direction of the second mounting portion 40. The catching portion 40B includes a section having a triangular or substantially triangular shape pointing to the front.

A positioning portion 40C configured to position the ECU 30 in a state of being spaced to the front from the front surface 33 of the air intake box 25 is provided at a rear end portion of the second mounting portion 40. The positioning portion 40C is thicker than a portion farther to the front than the positioning portion 40C in the second mounting portion 40.

As shown in FIG. 4, the third mounting portions 41 are provided in the upper region 33A. In detail, one third mounting portion 41 is provided between the right first mounting portion 39 in the upper region 33A and the right first mounting portion 39 in the lower region 33B. Another third mounting portion 41 is provided farther to the right than the third mounting portion 41. Each of the third mounting portions 41 preferably has a tubular shape extending forward. The third mounting portion 41 includes a distal end portion 41A at its front end portion.

The right surface 34 preferably has a triangular or a substantially triangular shape that narrows toward the lower side (refer to FIG. 5). The right surface 34 includes a step 34A preferably at the same position as that of the step 33C of the front surface 33 in the up-down direction. The left surface 36 also preferably has triangular or a substantially triangular shape that is similar to that of the right surface 34, and includes a step 36A preferably at the same position as that of the step 33C of the front surface 33 in the up-down direction. The rear surface 26 is arranged in a hanging manner between rear end edges of the right surface 34 and the left surface 36. At least a portion of the rear surface 26 is inclined forward as it extends downward (refer to FIG. 5).

The right surface 34 includes a lower region 34B located lower than the step 34A and an upper region 34C located higher than the step 34A. The lower region 34B and the upper region 34C are both flat in the up-down and front-rear directions, and the lower region 34B is shifted to the left farther than the upper region 34C.

The fourth mounting portions 42 are provided one each across a space therebetween in the front-rear direction at positions at the center or approximate center in the up-down direction in the lower region 34B (refer to FIG. 5). Each of the fourth mounting portions 42 preferably has a plate shape extending rightward, and is thin in the front-rear direction. Each of the fourth mounting portions 42 includes a distal end portion 42A at its right end portion. In all fourth mounting portions 42, the positions of the distal end portions 42A in the right-left direction are preferably the same or substantially the same. In the distal end portion 42A, a catching portion 42B projecting upward is provided.

In the upper region 34C, an intake-air outlet 43 is provided. The intake-air outlet 43 communicates with the interior of the air intake box 25.

The air intake box 25 includes an intake pipe 44 connected to the intake-air outlet 43. At least a portion of the intake pipe 44 is preferably made of a flexible material such as rubber or resin.

The intake pipe 44 includes a first end portion 44A connected to the intake-air outlet 43 and a second end portion 44B opposite to the first end portion 44A. The second end portion 44B is connected to the intake-air inlet 24A of the throttle body 24 (refer to FIG. 2). That is, the intake pipe 44 connects the intake-air outlet 43 of the air intake box 25 and the intake-air inlet 24A of the engine 3. Thus, air cleaned by the filter inside the air intake box 25 flows in the intake pipe 44 from the intake-air outlet 43 and is supplied to the throttle body 24 by the intake pipe 44.

The intake pipe 44 is curved after extending rightward from the first end portion 44A and extends forward to the second end portion 44B. When viewed from the right as shown in FIG. 5, the intake pipe 44 is inclined downward from the first end portion 44A toward the second end portion 44B.

Figure 6:
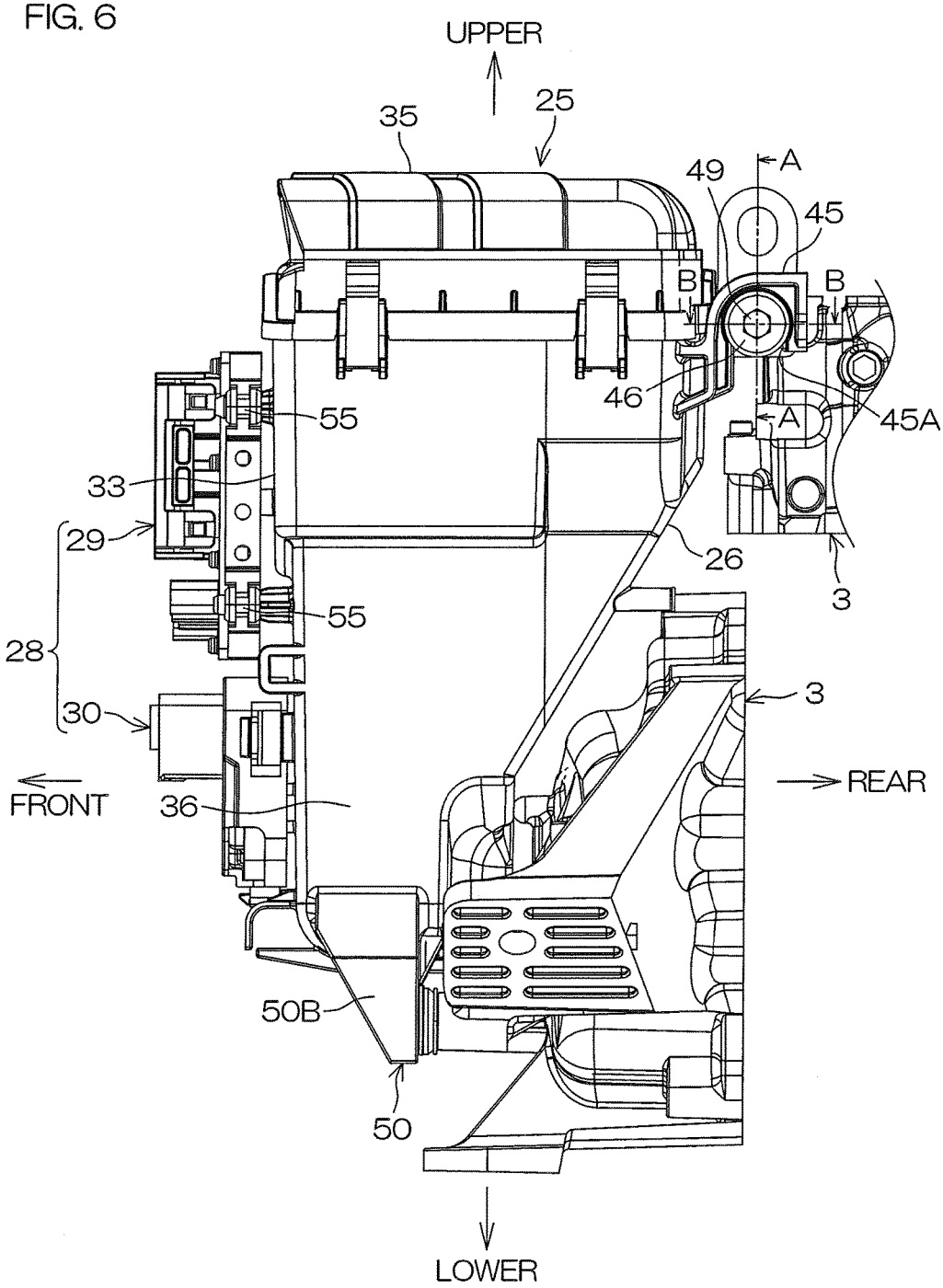
FIG. 6 is a side view of the principal area of the engine unit.
Figure 7A:
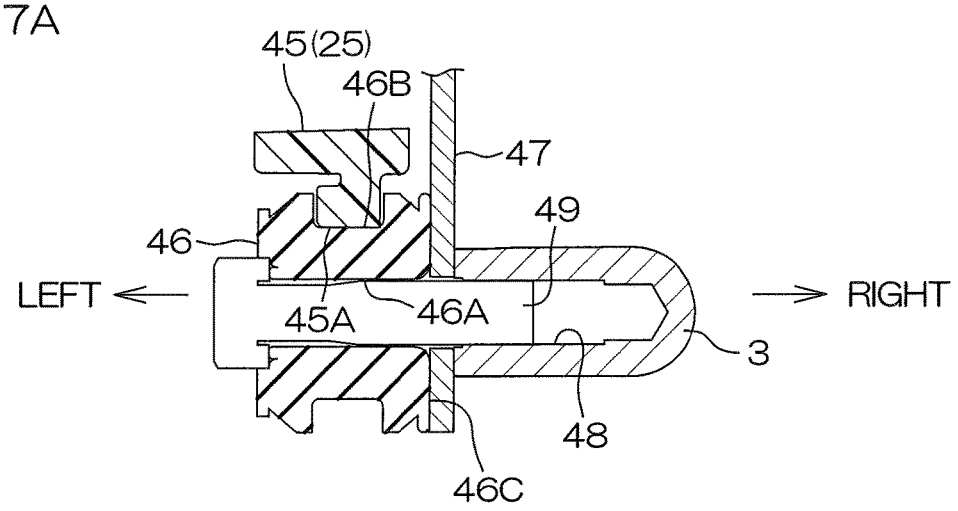
FIG. 7A is a sectional view taken along line A-A of FIG. 6.
Figure 7B:
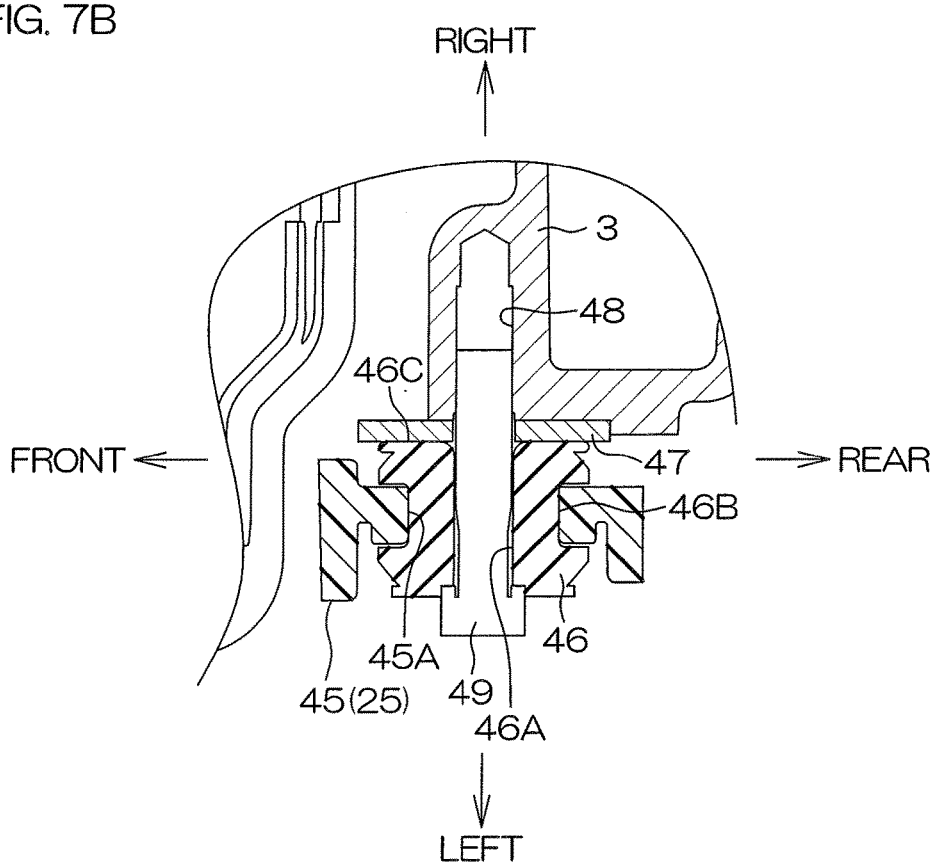
FIG. 7B is a sectional view taken along line B-B of FIG. 6.

FIG. 6 is a left side view of a coupling portion of the engine 3 and the air intake box 25 of the engine unit 23. FIG. 7A is a sectional view taken along line A-A of FIG. 6. FIG. 7B is a sectional view taken along line B-B of FIG. 6.

As shown in FIG. 6, first coupling portions 45 configured to couple an upper portion of the air intake box 25 to the engine 3 are provided one each at each of the upper end portions of the right surface 34 and the left surface 36 (refer also to FIG. 5). Each of the first coupling portions 45 includes an arm projecting farther to the rear than the rear surface 26. A cut-away 45A is provided at a rear end portion of each of the first coupling portions 45. The cut-away 45A preferably has a concave shape in which the rear end portion of the first coupling portion 45 is cut away from below, and penetrates through the rear end portion of the first coupling portion 45 in the right-left direction.

A vibration-proof member 46 is fit into the cut-away 45A from below. As shown in FIG. 7A and FIG. 7B, the vibration-proof member 46 includes, for example, a cylindrical grommet including a hole 46A that penetrates through the vibration-proof member 46 in the right-left direction, and is preferably made of an elastic material such as rubber. At an outer peripheral surface of the vibration-proof member 46, a groove 46B extends along its circumferential direction. A portion bordering the cut-away 45A in the first coupling portion 45 is fit into the groove 46B. The portion bordering the cut-away 45A in the first coupling portion 45 is, in the groove 46B, elastically sandwiched in the right-left direction by the vibration-proof member 46.

A first end surface 46C of the vibration-proof member 46 in the right-left direction is opposed in the right-left direction to a rear end portion of the engine 3. A washer 47 is preferably interposed between the first end surface 46C and the engine 3. A screw hole 48 is provided in the engine 3 at a position overlapping the hole 46A of the vibration-proof member 46 when viewed in the right-left direction.

A bolt 49 is inserted in the right-left direction through the hole 46A of the vibration-proof member 46, and inserted in the screw hole 48 of the engine 3. An upper portion of the air intake box 25 is thus mounted on the engine 3 via the vibration-proof members 46 in the right and left first coupling portions 45.

Figure 8:
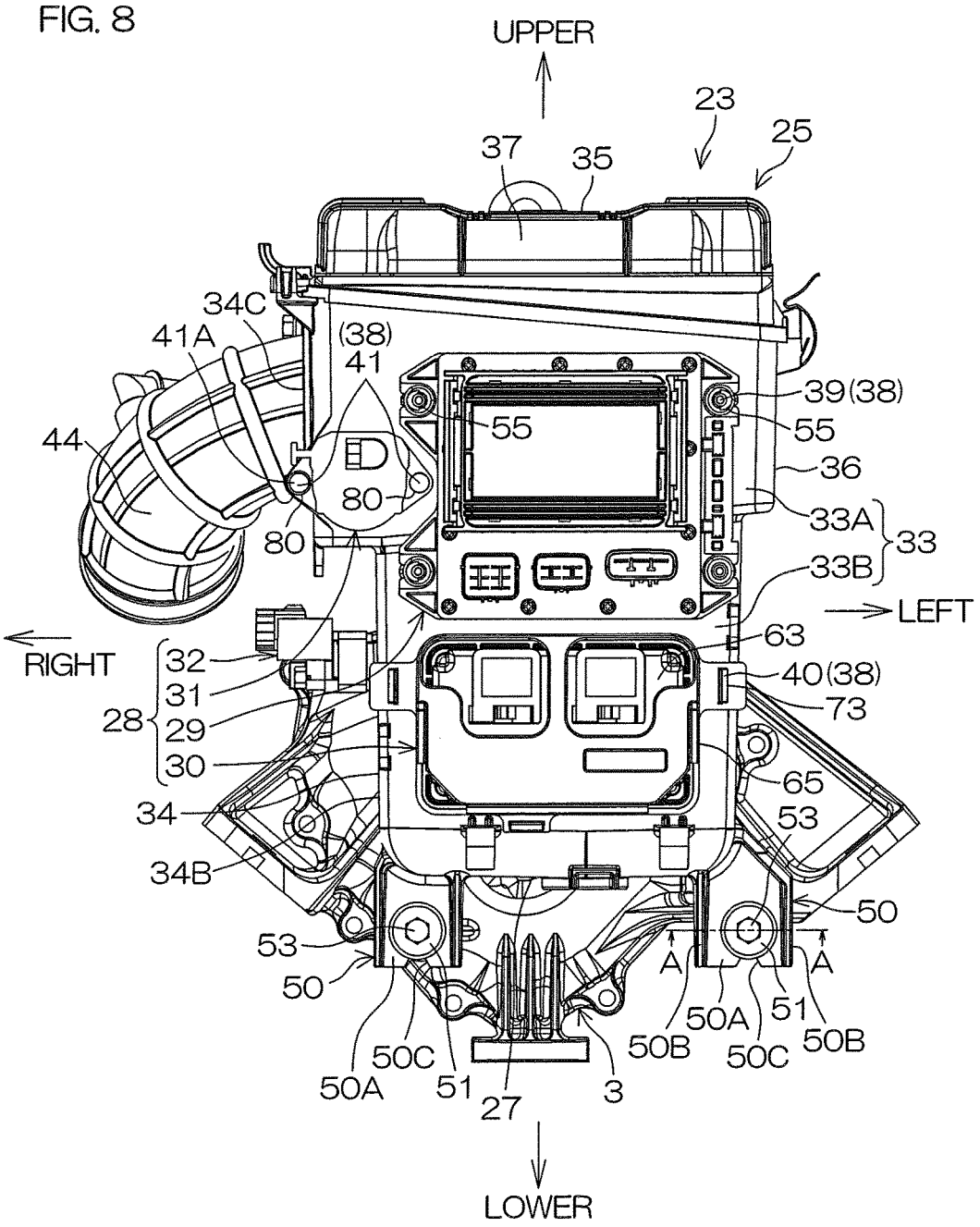
FIG. 8 is a front view of the principal area of the engine unit.
Figure 9:
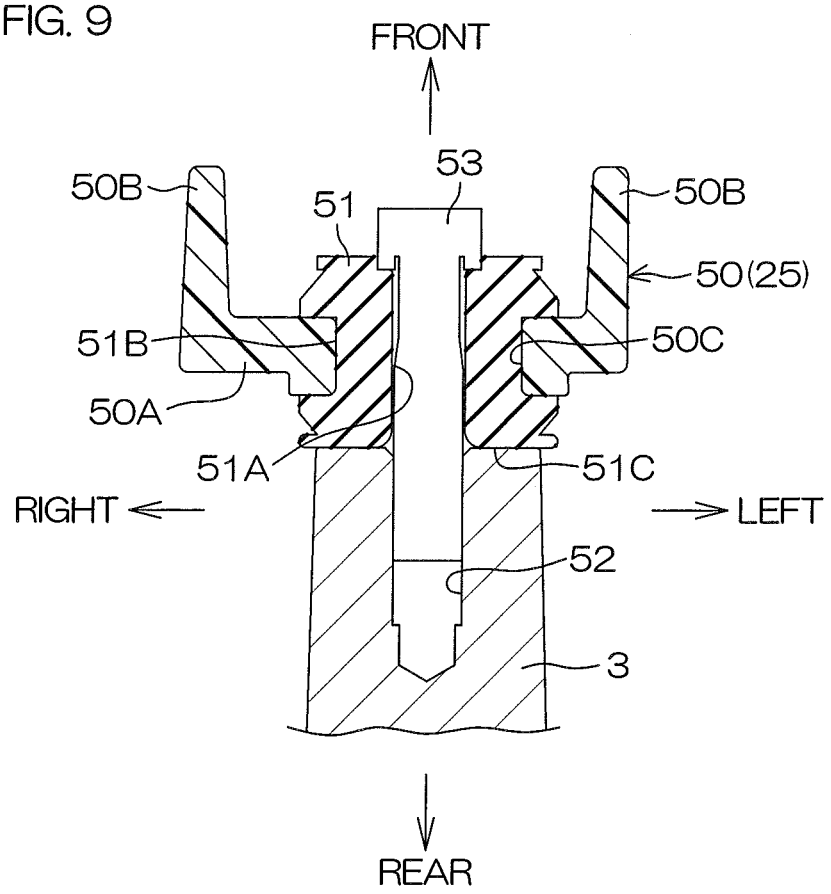
FIG. 9 is a sectional view taken along line A-A of FIG. 8.

FIG. 8 is a front view of a portion of the engine 3 and the entire air intake box 25 in the engine unit 23. FIG. 9 is a sectional view taken along line A-A of FIG. 8.

As shown in FIG. 8, second coupling portions 50 configured to couple a lower portion of the air intake box 25 to the engine 3 are provided one each at both end portions of the lower surface 27 in the right-left direction. Each of the second coupling portions 50 projects downward from the lower surface 27. Each of the second coupling portions 50 includes an integral and unitary main body portion 50A that is flat in the up-down and right-left directions and thin in the front-rear direction and a pair of side plate portions 50B that extend forward from both end portions of the main body portion 50A in the right-left direction. The main body portion 50A preferably has a rectangular or substantially rectangular shape when viewed in the front-rear direction. Each side board portion 50B preferably has a triangular or substantially triangular shape when viewed in the right-left direction (refer to FIG. 6).

A cut-away 50C is provided in the main body portion 50A of each of the second coupling portions 50. The cut-away 50C preferably has a concave shape in which the main body portion 50A is cut away from below, and penetrates through the main body portion 50A in the front-rear direction.

A vibration-proof member 51 is fit into the cut-away 50C from below. As shown in FIG. 9, the vibration-proof member 51 includes, for example, a cylindrical grommet including a hole 51A that penetrates through the vibration-proof member 51 in the front-rear direction, and is preferably made of an elastic material such as rubber. At an outer peripheral surface of the vibration-proof member 51, a groove 51B extends along its circumferential direction. A portion bordering the cut-away 50C in the main body portion 50A is fit into the groove 51B. The portion bordering the cut-away 50C in the main body portion 50A is, in the groove 51B, elastically sandwiched in the front-rear direction by the vibration-proof member 51.

A rear end surface 51C of the vibration-proof member 51 is in contact with a front end portion of the engine 3 from the front. A screw hole 52 is provided in the engine 3 at a position overlapping the hole 51A of the vibration-proof member 51 when viewed from the front.

A bolt 53 is inserted from the front through the hole 51A of the vibration-proof member 51, and inserted into the screw hole 52 of the engine 3. A lower portion of the air intake box 25 is thus mounted on the engine 3 via the vibration-proof members 51 in the right and left second coupling portions 50.

As described above, the air intake box 25 mounted via the intake pipe 44, the vibration-proof members 46, and the vibration-proof members 51 is elastically supported by the engine 3.

Next, the electrical devices 28 discussed above will be described.

Figure 10:
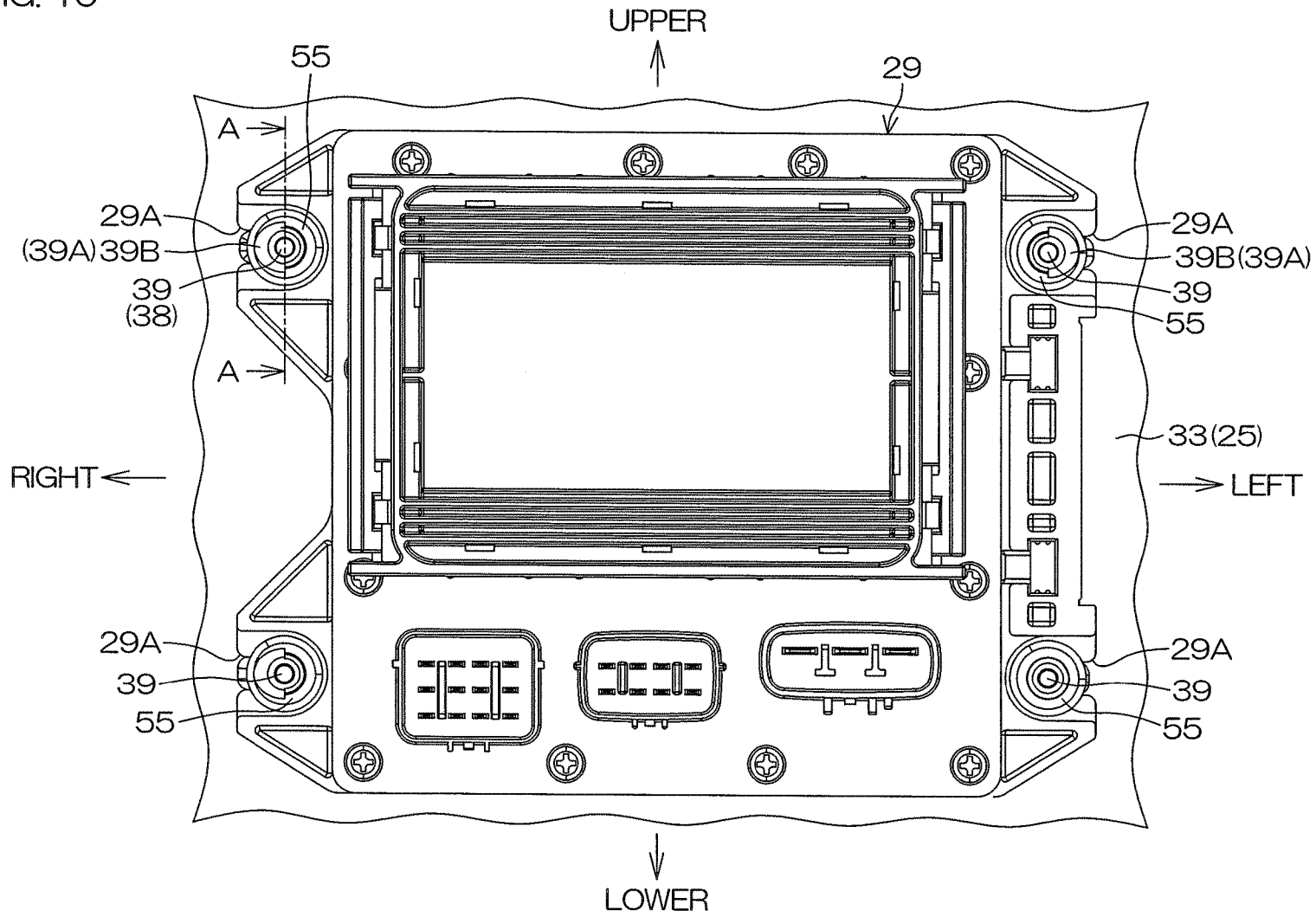
FIG. 10 is an enlarged view of the fuse box and the periphery thereof in FIG. 8.
Figure 11:
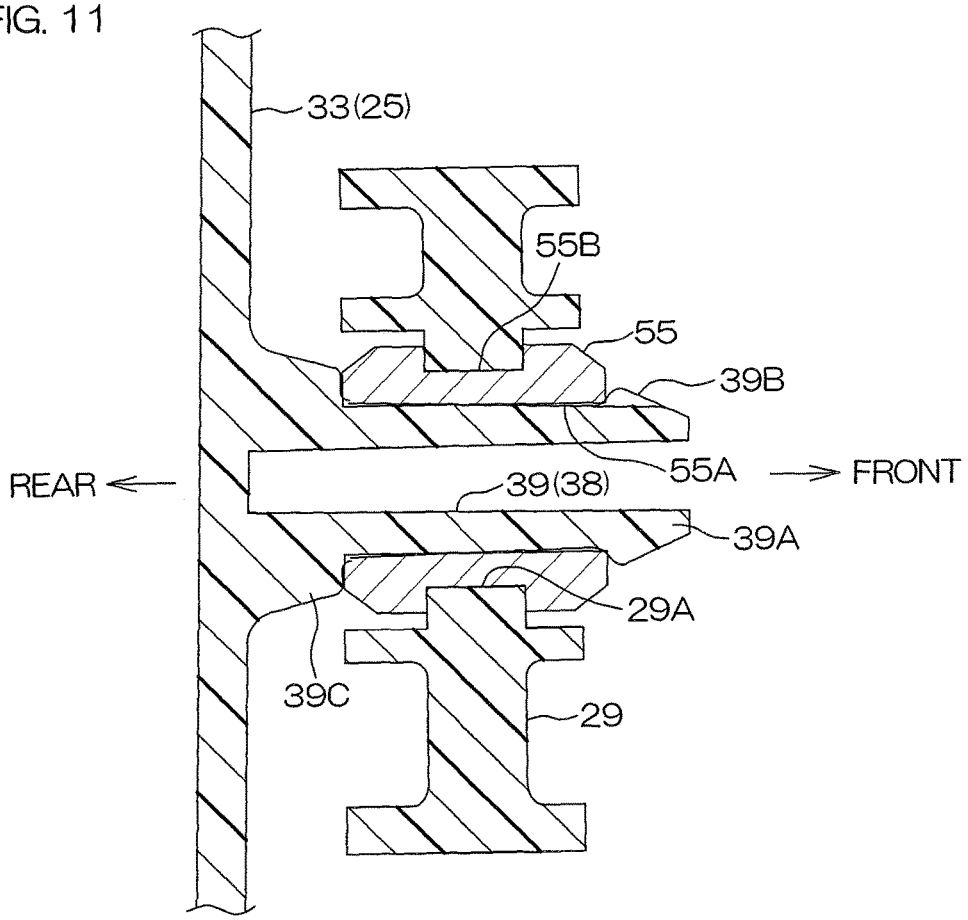
FIG. 11 is a sectional view taken along line A-A of FIG. 10.

FIG. 10 is an enlarged view of the fuse box 29 and the periphery thereof in FIG. 8. FIG. 11 is a sectional view taken along line A-A of FIG. 10.

As shown in FIG. 10, the fuse box 29 preferably has a rectangular or substantially rectangular shape that is longer in the right-left direction when viewed in the front-rear direction. The fuse box 29 is a hollow body that is thin in the front-rear direction, and stores a plurality of fuses.

Cut-aways 29A are provided one each at upper and lower end portions of each of the right surface and left surface of the fuse box 29. Thus, a total of four cut-aways 29A preferably are provided, for example. The two cut-aways 29A in the right surface of the fuse box 29 preferably have a concave shape in which right end portions of the fuse box 29 are cut away from the right, and penetrate through the fuse box 29 in the front-rear direction. The two cut-aways 29A in the left surface of the fuse box 29 preferably have a concave shape in which left end portions of the fuse box 29 are cut away from the left, and penetrate through the fuse box 29 in the front-rear direction.

The fuse box 29 includes brackets 55 that are preferably the same in number as the cut-aways 29A. As shown in FIG. 11, the bracket 55 includes, for example, a cylindrical grommet including a hole 55A that penetrates through the bracket 55 in the front-rear direction, and is preferably made of a vibration-proof material such as rubber. At an outer peripheral surface of the bracket 55, a groove 55B extends along its circumferential direction.

The brackets 55 are mounted one each in each of the cut-aways 29A. A portion bordering each cut-away 29A in the fuse box 29 is fit into the groove 55B. The portion bordering the cut-away 29A in the fuse box 29 is, in the groove 55B, elastically sandwiched in the front-rear direction by the bracket 55.

When the fuse box 29 is mounted on the air intake box 25, the fuse box 29 is grasped by the user and disposed in front of the air intake box 25. At this time, the fuse box 29 is positioned such that the hole 55A of each of the brackets 55 coincides with any of the first mounting portions 39 in the front surface 33 of the air intake box 25. Then, the fuse box 29 is brought close to the front surface 33 of the air intake box 25. The first mounting portions 39 of the front surface 33 are thus inserted one each from the rear into the hole 55A of each of the brackets 55 in the fuse box 29.

As shown in FIG. 11, when the distal end portion 39A of each of the first mounting portions 39 extends forward from the hole 55A, mounting of the fuse box 29 with respect to the air intake box 25 is completed. Most of the mounted fuse box 29 is located in the upper region 33A of the front surface 33 of the air intake box 25 (refer to FIG. 8). Thus, the fuse box 29 is mounted on an upper portion of the air intake box 25.

As shown in FIG. 11, in the state where mounting of the fuse box 29 with respect to the air intake box 25 is completed, the catching portion 39B of each of the distal end portions 39A is caught on a portion bordering the hole 55A in the bracket 55 from the front. Also, the positioning portions 39C of each of the first mounting portions 39 are in contact with the bracket 55 from the rear. The bracket 55 is thus sandwiched by the catching portion 39B and the positioning portions 39C in the front-rear direction. Thus, the fuse box 29 is elastically supported by the air intake box 25 via the brackets 55.

On the other hand, when the fuse box 29 is removed from the air intake box 25, the fuse box 29 is grasped by the user and drawn to the front of the air intake box 25. When the fuse box 29 is drawn forward by a certain force or more, the catching portion 39B of each of the first mounting portions 39 is pushed by the portion bordering the hole 55A in the bracket 55 to be deformed. The catching portion 39B accordingly comes off the portion bordering the hole 55A in the bracket 55 to enter into the hole 55A. In response thereto, the first mounting portion 39 comes out rearward from the hole 55A of the bracket 55. When all first mounting portions 39 come out from the holes 55A of the bracket 55, removal of the fuse box 29 is completed.

Thus, the fuse box 29 is removably mounted without using an implement with respect to the first mounting portions 39.

Figure 12A:
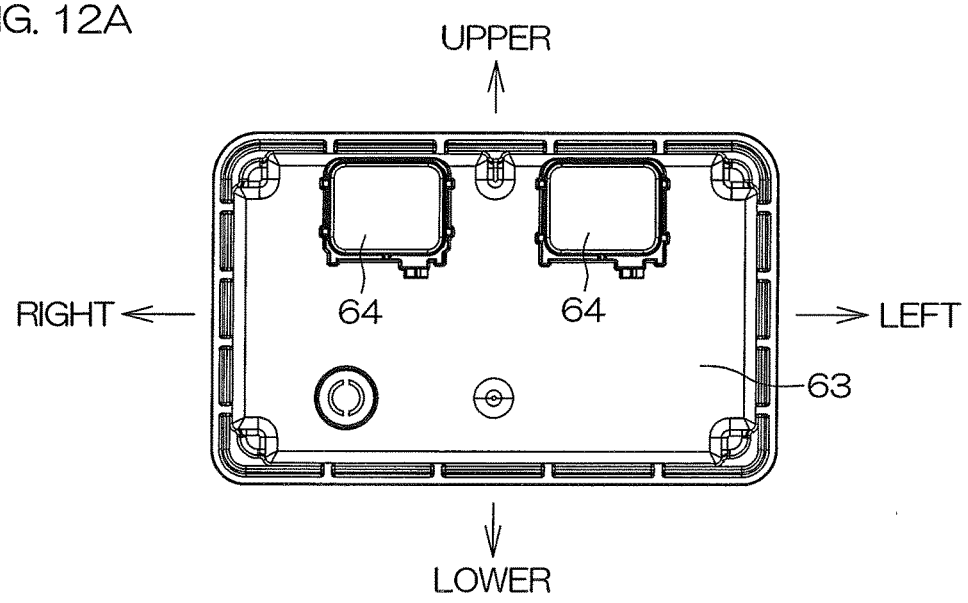
FIG. 12A is a front view of an ECU main body in an ECU.
Figure 12B:
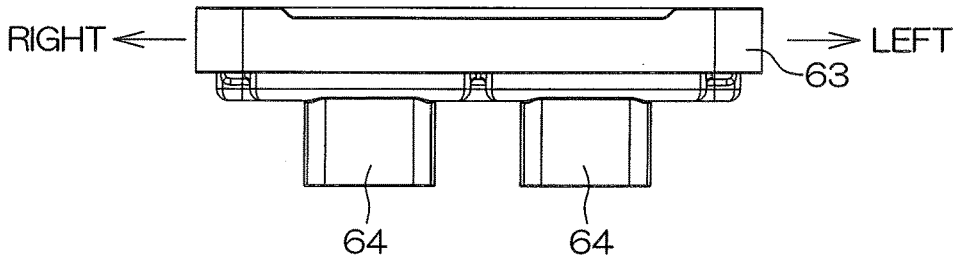
FIG. 12B is a plan view of the ECU main body.
Figure 12C:
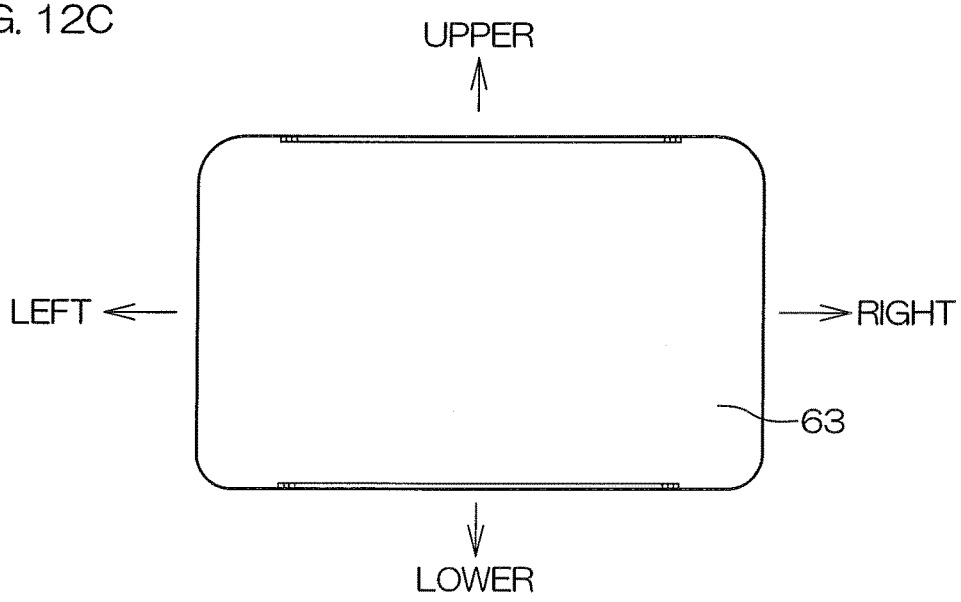
FIG. 12C is a back view of the ECU main body.

The ECU 30 includes a box-shaped ECU main body 63 including a built-in substrate mounted with a CPU, a memory, etc. FIG. 12A is a front view of the ECU main body 63. FIG. 12B is a plan view of the ECU main body 63. FIG. 12C is a rear view of the ECU main body 63.

As shown in FIG. 12A and FIG. 12C, the ECU main body 63 preferably has a rectangular or substantially rectangular shape that is longer in the right-left direction and rounded at four corners when viewed in the front-rear direction. As shown in FIG. 12B, the ECU main body 63 is thin in the front-rear direction. Two connectors 64 project forward in an upper end portion of a front surface of the ECU main body 63 in a manner separated to the right and left.

Figure 13A:
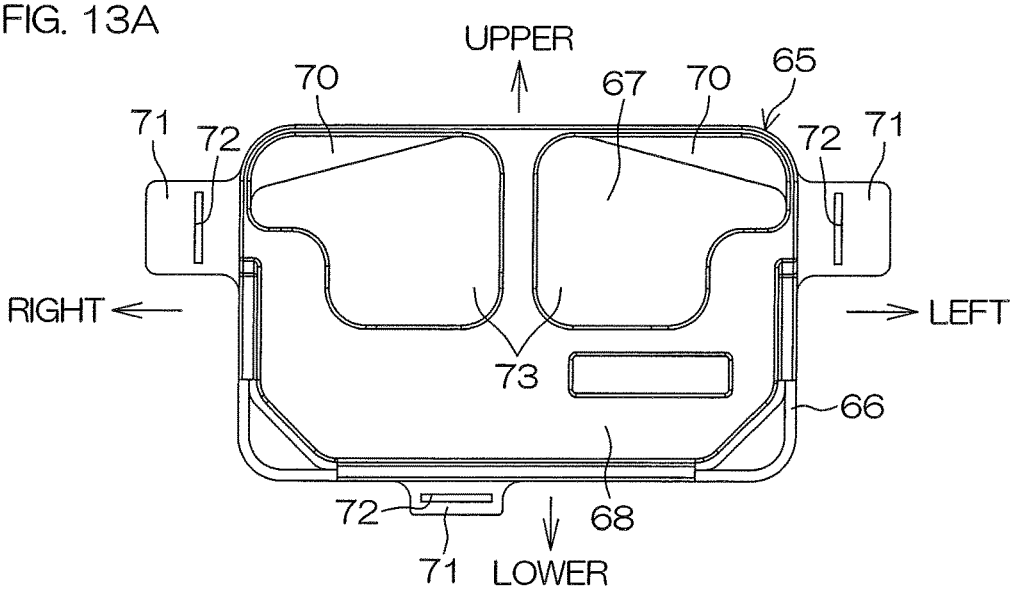
FIG. 13A is a front view of a bracket holding the ECU main body.
Figure 13B:
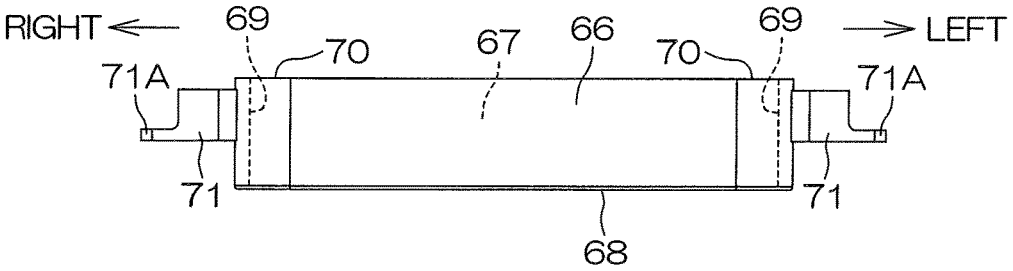
FIG. 13B is a plan view of the bracket.
Figure 13C:
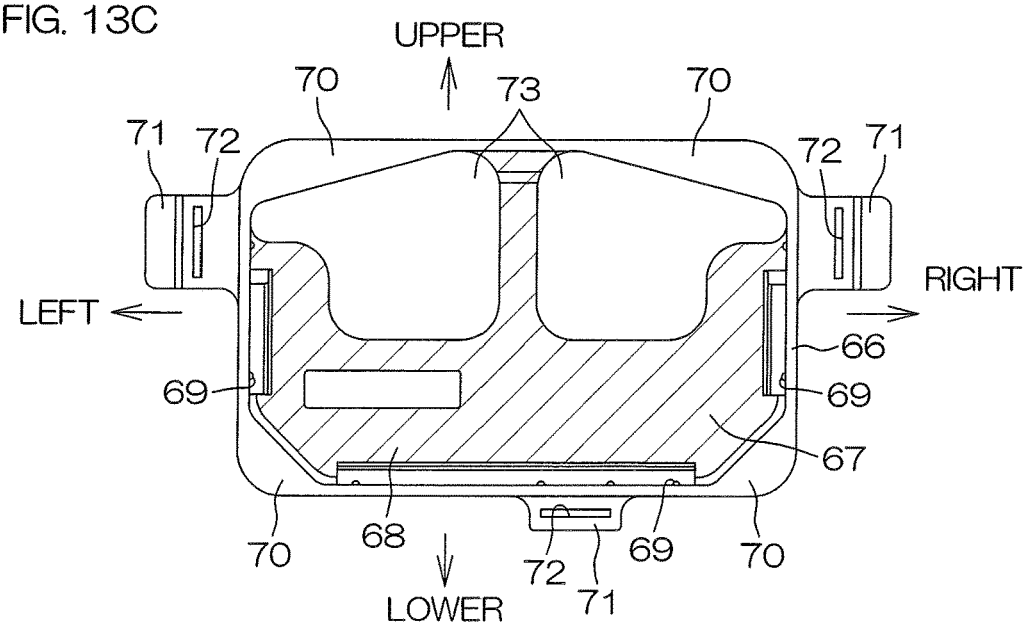
FIG. 13C is a back view of the bracket.

The ECU 30 includes a bracket 65 configured to hold the ECU main body 63. FIG. 13A is a front view of the bracket 65. FIG. 13B is a plan view of the bracket 65. FIG. 13C is a rear view of the bracket 65.

The bracket 65 shown in FIG. 13A to FIG. 13C is preferably made of a vibration-proof material such as rubber. As shown in FIG. 13C, the bracket 65 includes an integral and unitary peripheral wall 66 having a rectangular or substantially rectangular frame shape that extends along an outer edge of the ECU main body 63 when viewed in the front-rear direction and a lid portion 68 that blocks a space 67 surrounded by the peripheral wall 66 from the front. In addition, the lid portion 68 is hatched in FIG. 13C in order to distinguish between the peripheral wall 66 and the lid portion 68.

A plurality of positioning portions 69 are provided on an inner peripheral surface of the peripheral wall 66. The positioning portions 69 are streaks extending in the front-rear direction, and when viewed in the front-rear direction, project from the inner peripheral surface of the peripheral wall 66 and are spaced apart at intervals. At the four corners of the peripheral wall 66 when viewed in the front-rear direction, retaining portions 70 are provided. The retaining portions 70 have a triangular or substantially triangular plate shape that are thin in the front-rear direction. When viewed in the front-rear direction, each of the retaining portions 70 extends outward into the space 67 from a rear end edge of the peripheral wall 66.

Flange portions 71 that are the same in number (here, preferably three, for example) as the second mounting portions 40 are provided in a rear portion of an outer peripheral surface of the peripheral wall 66 (refer also to FIG. 13B). One flange portion 71 projects rightward from a right surface of the peripheral wall 66. Another flange portion 71 projects leftward from a left surface of the peripheral wall 66. Still another flange portion 71 projects downward from a lower surface of the peripheral wall 66. The flange portions 71 have a plate shape whose thickness direction is the front-rear direction. End portions 71 that are spaced apart from the peripheral wall 66 in the two flange portions 71 on the right surface and left surface of the peripheral wall 66 are one step thinner (refer to FIG. 13B).

Each of the flange portions 71 includes one hole 72 that penetrates through the flange portion 71 in the front-rear direction. The holes 72 of the two flange portions 71 on the right surface and left surface of the peripheral wall 66 are longer in the up-down direction, and provided at a portion excluding the end portion 71A in the flange portion 71. The hole 72 of the flange portion 71 on the lower surface of the peripheral wall 66 is longer in the right-left direction.

The lid portion 68 has a plate shape that is thin in the front-rear direction. Insertion holes 73 that penetrate through an upper end portion of the lid portion 68 in the front-rear direction are provided side by side in the right-left direction.

Figure 14A:
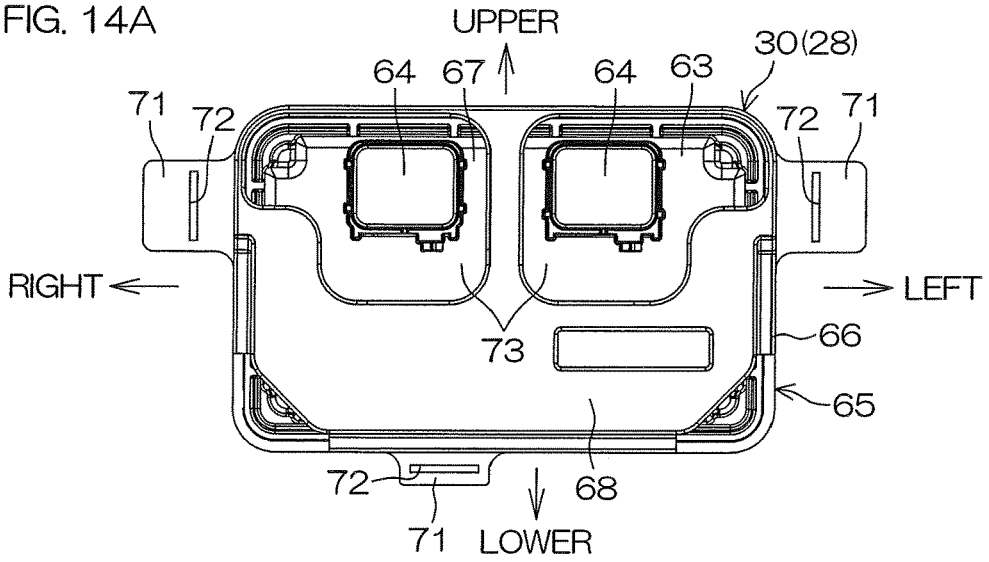
FIG. 14A is a front view of an ECU completed by combination of the ECU main body and bracket.
Figure 14B:
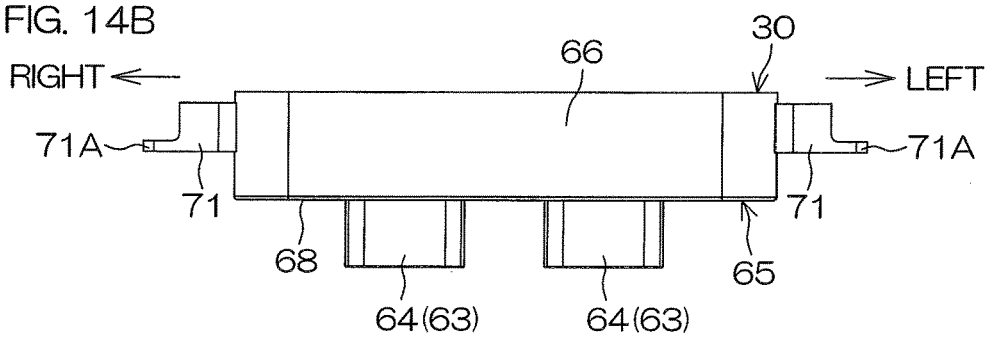
FIG. 14B is a plan view of the ECU.
Figure 14C:
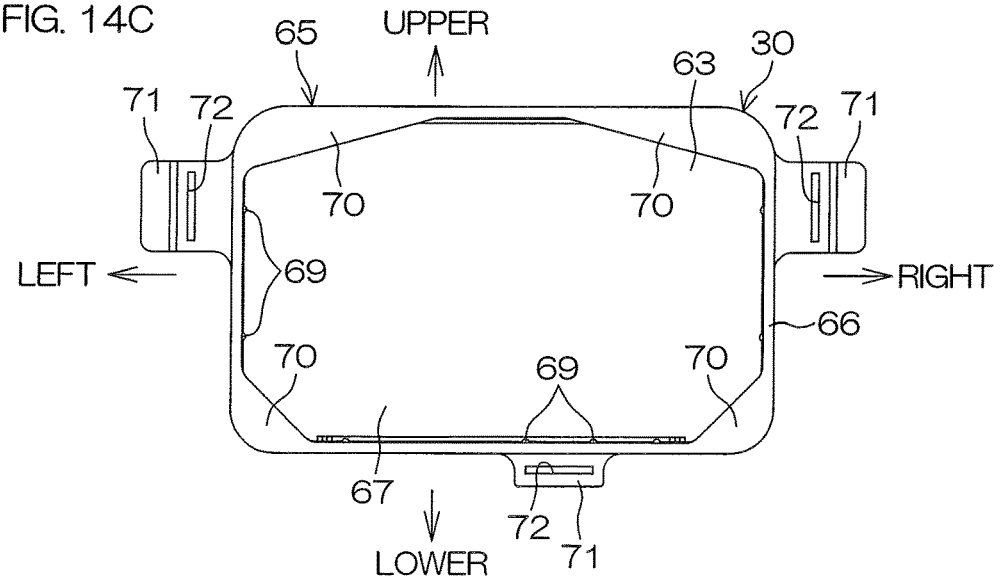
FIG. 14C is a back view of the ECU.

FIG. 14A is a front view of the ECU 30 completed by combination of the ECU main body 63 and the bracket 65. FIG. 14B is a plan view of the ECU 30. FIG. 14C is a rear view of the ECU 30.

As shown in FIG. 14A, due to the bracket 65 covering the ECU main body 63 from the front, the ECU main body 63 and the bracket 65 are combined to complete the ECU 30. In the completed ECU 30, the ECU main body 63 is accommodated inside the space 67 of the bracket 65. The two connectors 64 in the ECU main body 63 are inserted one each through the insertion holes 73 of the lid portion 68, and extend forward from the lid portion 68 (refer also to FIG. 14B).

As shown in FIG. 14C, when viewed from the rear, the peripheral wall 66 of the bracket 65 surrounds the ECU main body 63. The plurality of positioning portions 69 on the inner peripheral surface of the peripheral wall 66 are elastically in contact with the ECU main body 63. The ECU main body 63 is thus prevented from rattling inside the space 67 of the bracket 65. Moreover, the retaining portions 70 at the four corners of the peripheral wall 66 are in contact with the four corners of a rear surface of the ECU main body 63 from the rear. The ECU main body 63 is thus prevented from coming off the bracket 65.

Figure 15:
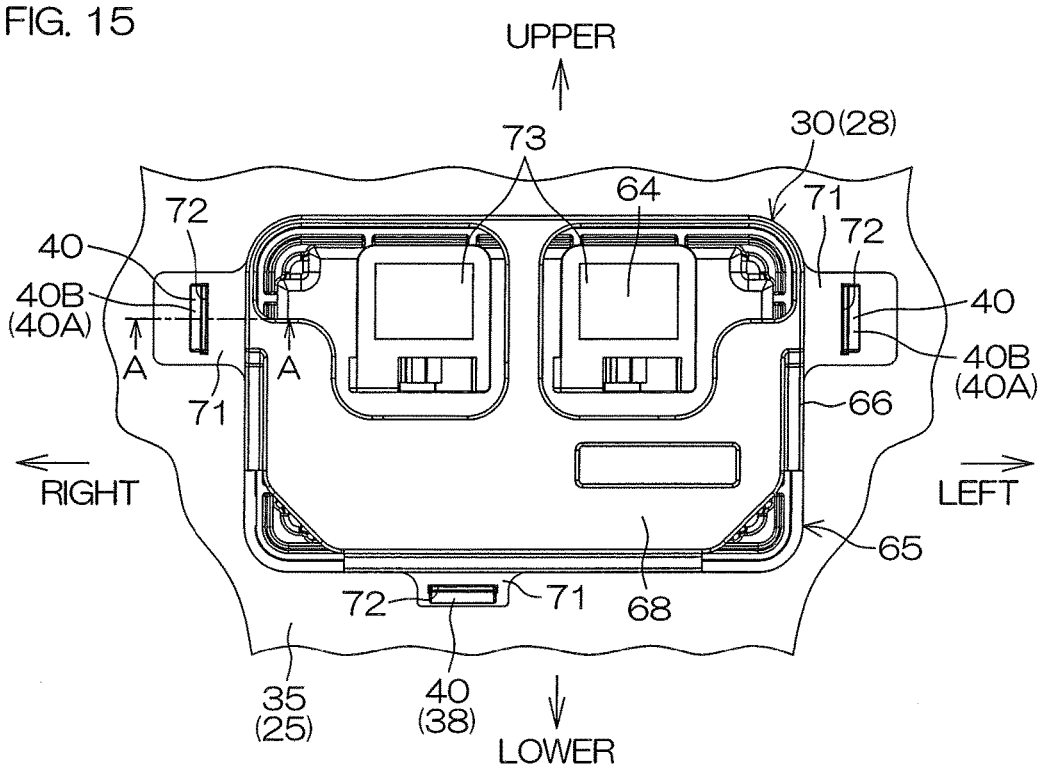
FIG. 15 is an enlarged view of the ECU and the periphery thereof in FIG. 8.
Figure 16:
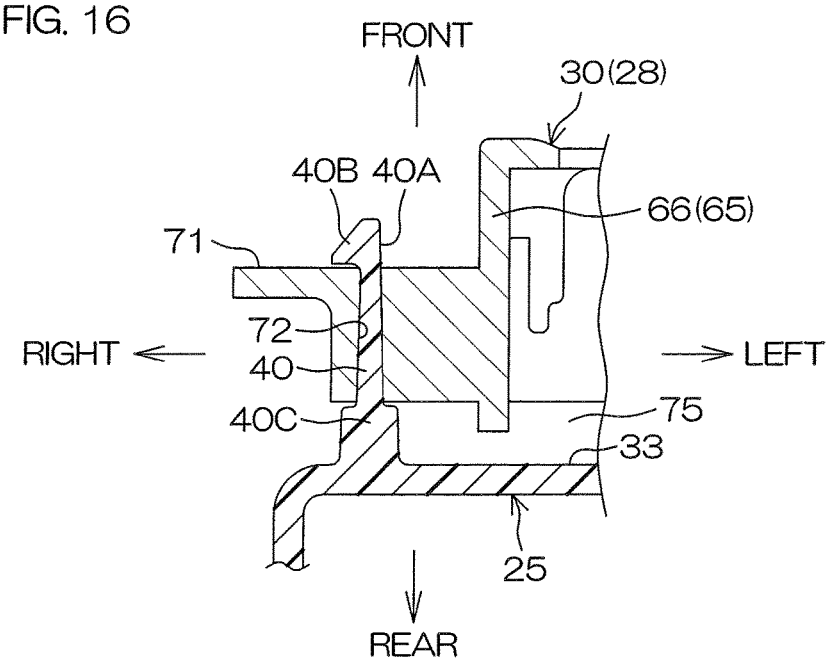
FIG. 16 is a sectional view taken along line A-A of FIG. 15.

FIG. 15 is an enlarged view of the ECU 30 and the periphery thereof in FIG. 8. FIG. 16 is a sectional view taken along line A-A of FIG. 15.

As shown in FIG. 15, when the ECU 30 is mounted on the air intake box 25, the ECU 30 is grasped by the user and disposed in front of the air intake box 25. At this time, the ECU 30 is positioned such that the hole 72 of each of the flange portions 71 in the bracket 65 coincides with any of the second mounting portions 40 in the front surface 33 of the air intake box 25. Then, the ECU 30 is brought close to the front surface 33 of the air intake box 25. The second mounting portions 40 of the front surface 33 are thus inserted one each from the rear into each of the holes 72.

As shown in FIG. 16, when the distal end portion 40A of each of the second mounting portions 40 extends forward from the hole 72, mounting of the ECU 30 with respect to the air intake box 25 is completed.

As shown in FIG. 16, in the state where mounting of the ECU 30 with respect to the air intake box 25 is completed, the catching portion 40B of each of the distal end portions 40A is caught on the flange portion 71 bordering the hole 72 in the bracket 65 from the front. Also, the positioning portion 40C of each of the second mounting portions 40 is in contact with the flange portion 71 of the bracket 65 from the rear. The bracket 65 is thus sandwiched by the catching portion 40B and the positioning portion 40C in the front-rear direction. Thus, the ECU 30 is elastically supported by the air intake box 25 via the bracket 65.

The positioning portion 40C, due to contact with the flange portion 71 from the rear, causes the entire ECU 30 to be spaced apart to the front from the front surface 33 of the air intake box 25. Because a gap 75 is provided between the ECU 30 and the front surface 33, the ECU 30 is cooled by air that flows through the gap 75.

On the other hand, when the ECU 30 is removed from the air intake box 25, the ECU 30 is grasped by the user and drawn to the front of the air intake box 25. When the ECU 30 is drawn forward by a certain force or more, the catching portion 40B of each of the second mounting portions 40 is pushed by the flange portion 71 to be deformed, and enters into the hole 72 of the flange portion 71. When the ECU 30 is drawn farther to the front, the second mounting portion 40 comes out rearward from the hole 72. When all second mounting portions 40 come out from the holes 72, removal of the ECU 30 is completed.

Thus, the ECU 30 is removably mounted without using an implement with respect to the second mounting portions 40.

As shown in FIG. 8, the overturn switch 31 includes holes 80 at both end portions in the right-left direction. The respective holes 80 penetrate through the overturn switch 31 in the front-rear direction.

When the overturn switch 31 is mounted on the air intake box 25, the overturn switch 31 is grasped by the user and disposed in front of the air intake box 25. At this time, the overturn switch 31 is positioned such that each of the holes 80 coincides with any of the third mounting portions 41 in the front surface 33 of the air intake box 25. Then, the overturn switch 31 is brought close to the front surface 33 of the air intake box 25. The third mounting portions 41 of the front surface 33 are thus inserted one each from the rear into each of the holes 80 in the overturn switch 31. When the distal end portion 41A of each of the third mounting portions 41 extends forward from the hole 80, mounting of the overturn switch 31 with respect to the air intake box 25 is completed.

On the other hand, when the overturn switch 31 is removed from the air intake box 25, the overturn switch 31 is grasped by the user, and drawn to the front of the air intake box 25. When the overturn switch 31 is drawn forward by a certain force or more, the third mounting portion 41 comes out rearward from the hole 80 of the overturn switch 31. When all third mounting portions 41 come out from the holes 80, removal of the overturn switch 31 is completed.

Thus, the overturn switch 31 is removably mounted without using an implement with respect to the third mounting portions 41.

As shown in FIG. 2, the starter unit 32 includes holes 81 in both end portions in the front-rear direction. The respective holes 81 penetrate through the starter unit 32 in the right-left direction.

When the starter unit 32 is mounted on the air intake box 25, the starter unit 32 is grasped by the user and disposed on the right side of the air intake box 25. At this time, the starter unit 32 is positioned such that each of the holes 81 coincides with any of the fourth mounting portions 42 (refer to FIG. 5) on the right surface 34 of the air intake box 25. Then, the starter unit 32 is brought close to the right surface 34 of the air intake box 25. The fourth mounting portions 42 of the right surface 34 are thus inserted one each from the left side into each of the holes 81 in the starter unit 32.

When the distal end portion 42A of each of the fourth mounting portions 42 extends rightward from the hole 81, mounting of the starter unit 32 with respect to the air intake box 25 is completed.

In the state where mounting of the starter unit 32 with respect to the air intake box 25 is completed, the catching portion 42B of each of the distal end portions 42A is caught on a portion bordering the hole 81 in the starter unit 32 from the right.

On the other hand, when the starter unit 32 is removed from the air intake box 25, the starter unit 32 is grasped by the user and drawn to the right side of the air intake box 25. When the starter unit 32 is drawn rightward by a certain force or more, the catching portion 42B of each of the fourth mounting portions 42 is pushed by the portion bordering the hole 81 in the starter unit 32 to be deformed, and enters into the hole 81. The catching portion 42B accordingly comes off the portion bordering the hole 81 in the starter unit 32. In response thereto, the fourth mounting portion 42 comes out leftward from the hole 80 of the starter unit 32. When all fourth mounting portions 42 come out from the holes 80, removal of the starter unit 32 is completed.

Thus, the starter unit 32 is removably mounted without using an implement with respect to the fourth mounting portions 42.

As described above, in the jet propelled watercraft 1A, the electrical devices 28 are mounted on the surfaces of the air intake box 25 (the front surface 33 and the right surface 34) that are different from the rear surface 26 that is opposed to the engine 3. Thus, at the time of maintenance, the electrical devices 28 are easily accessed without obstruction by the engine 3. Particularly, as shown in FIG. 1, in the arrangement where the engine 3 is accommodated in the watercraft body 2 under the opening portion 22, the electrical devices 28 are mounted on the surfaces of the air intake box 25 (the front surface 33 and the right surface 34) that are different from both the rear surface 26 opposed to the engine 3 and the lower surface 27. Thus, at the time of maintenance, the electrical devices 28 are easily accessed from the opening portion 22 located thereabove.

The electrical devices 28 are easily mountable and removable without using an implement such as a tool with respect to the mounting portions 38 provided on the air intake box 25. In detail, in the case of the fuse box 29, as shown in FIG. 11, by inserting and pulling the first mounting portions 39 of the air intake box 25 into and out of the holes 55A in the brackets 55, the fuse box 29 is mounted on and removed from the first mounting portions 39 without using an implement. In the case of the ECU 30, as shown in FIG. 16, by inserting and pulling the second mounting portions 40 of the air intake box 25 into and out of the holes 72 in the bracket 65, the ECU 30 is mounted on and removed from the second mounting portions 40 without using an implement.

As shown in FIG. 8, among the electrical devices 28, the fuse box 29 that is frequently inspected at the time of malfunction of the jet propelled watercraft 1A is mounted on an upper portion of the air intake box 25. Thus, at the time of maintenance, the fuse box 29 is easily accessed from above.

As a result of these unique structural features and configurations, the electrical devices 28 have improved maintainability.

As shown in FIG. 11, in the case of the fuse box 29, the catching portion 39B of the distal end portion 39A is caught on the portion bordering the hole 55A in the bracket 55 with the distal end portion 39A of the first mounting portion 39 extending out of the hole 55A of the bracket 55. Because the first mounting portion 39 is prevented from unexpectedly coming out from the hole 55A, the fuse box 29 stays mounted on the first mounting portion 39.

As shown in FIG. 16, in the case of the ECU 30, the catching portion 40B of the distal end portion 40A is caught on the portion bordering the hole 72 in the bracket 65 with the distal end portion 40A of the second mounting portion 40 extending out of the hole 72 of the bracket 65. Because the second mounting portion 40 is prevented from unexpectedly coming out of the hole 72, the ECU 30 stays mounted on the second mounting portion 40.

In addition, in the fourth mounting portion 42 on which the starter unit 32 is mounted, the catching portion 42B is provided similarly to the catching portion 39B and the catching portion 40B (refer to FIG. 4), and a similar effect is provided with the starter unit 32. Also, if an arrangement similar to the catching portion 39B or the catching portion 40B is provided in the third mounting portion 41, a similar effect is provided with the overturn switch 31.

As shown in FIG. 1, the electrical devices 28 mounted on surfaces of the air intake box 25 that are different from the rear surface 26 opposed to the engine 3 are prevented from being thermally affected by the engine 3. Also, as compared with when the electrical devices 28 are mounted on the watercraft body 2, it is not necessary to provide separate brackets to mount the electrical device 28 on the watercraft body 2, and wiring from the electrical device 28 to the engine 3 is shortened. Further, because the electrical devices 28 are disposed in a concentrated manner on the front surface 33 with the intake-air inlet 37 that is unlikely to be splashed with water in the air intake box 25, splashing of the electrical device 28 with water is prevented as much as possible.

As shown in FIG. 2, the air intake box 25 is mounted on the engine 3 via the vibration-proof members 46 and the vibration-proof members 51 (refer also to FIG. 8). Further, the flexible air intake pipe 44 connects the intake-air outlet 43 of the air intake box 25 and the intake-air inlet 24A of the engine 3. Thus, both vibrations of the air intake box 25 and vibrations of the electrical device 28 mounted on the air intake box 25 are significantly reduced or prevented by the vibration-proof members 46, the vibration-proof members 51, and the air intake pipe 44.

Moreover, as shown in FIG. 8, vibrations of the fuse box 29 are also significantly reduced or prevented by the brackets 55 made of a vibration-proof material. Similarly, vibrations of the ECU 30 are also significantly reduced or prevented by the bracket 65 made of a vibration-proof material. Vibrations of the air intake box 25 on which the fuse box 29 and the ECU 30 are mounted is significantly reduced or prevented by the vibration-proof members 46, the vibration-proof members 51, and the air intake pipe 44 as mentioned above. Accordingly, the fuse box 29 is doubly prevented from receiving vibrations by the brackets 55 and the vibration-proof material (the vibration-proof members 46, the vibration-proof members 51, and the air intake pipe 44) of the air intake box 25. Similarly, the ECU 30 is doubly prevented from receiving vibrations by the bracket 65 and the vibration-proof material of the air intake box 25. In addition, like the fuse box 29 and the ECU 30, if vibration thereof is suppressed by the brackets 55 and the bracket 65, the air intake box 25 may be rigidly fixed to the engine 3.

The fuse box 29 and the bracket 55 are preferably integrally and unitarily molded with each other. Similarly, the ECU 30 and the bracket 65 are preferably integrally and unitarily molded with each other.

In addition, the overturn switch 31 is not fixed to the air intake box 25 via a vibration-proof material to improve detection accuracy. However, because vibrations of the air intake box 25 are significantly reduced or prevented by the vibration-proof members 46 and the vibration-proof members 51, vibrations of the overturn switch 31 are also indirectly significantly reduced or prevented.

For example, the electrical devices 28 are preferably provided on the upper surface 35 and the left surface 36, without being limited to the front surface 33 and the right surface 34, as long as the surface of the air intake box 25 is different from both the rear surface 26 opposed to the engine 3 and the lower surface 27.

The arrangement where the electrical devices 28 are removably mounted without using an implement with respect to the mounting portions 38 provided on a surface of the air intake box 25 that is different from a surface opposed to the engine 3 can also be applied to a vehicle 1 other than the jet propelled watercraft 1A described above.

The air intake box 25 also includes a surge tank.

The electrical devices 28 are not limited to electrical components configured to control the engine 3, and also may include, for example, electrical components configured to control instruments such as meters and an immobilizer on the vehicle 1.

The respective numbers of the first mounting portions 39 to the fourth mounting portions 42 can be arbitrarily changed.

Figure 17:
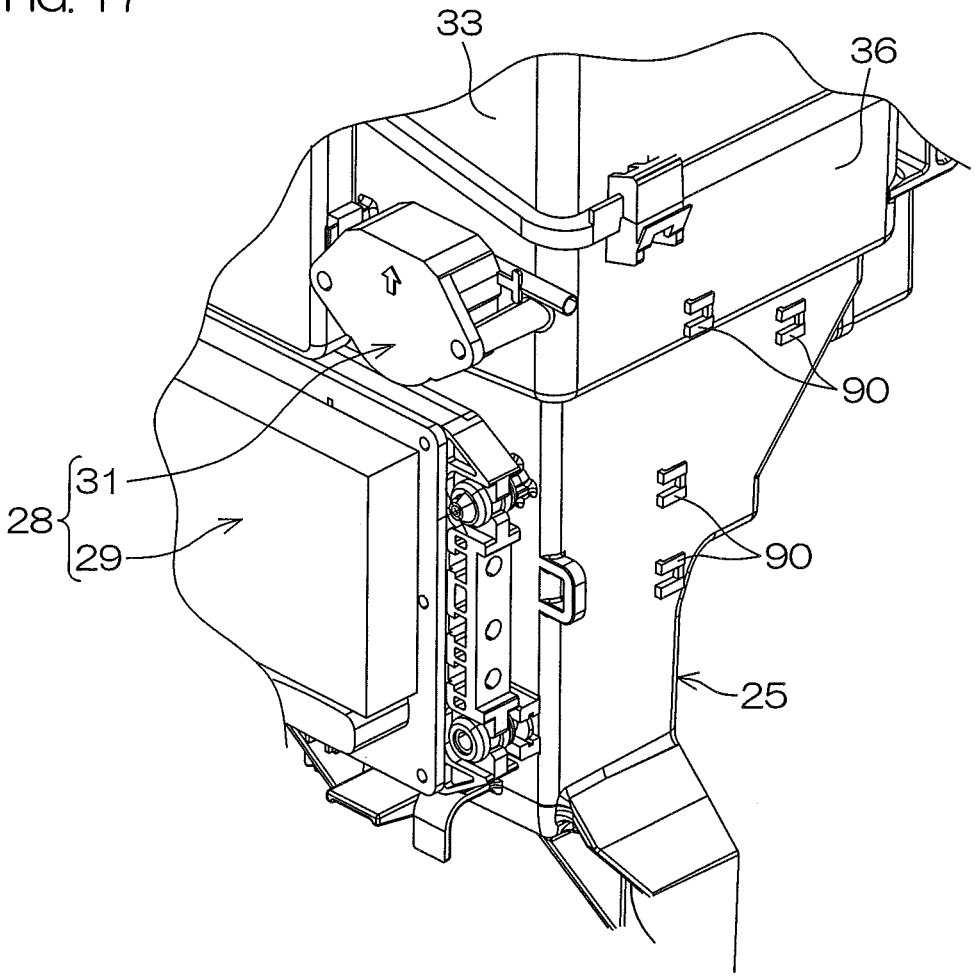
FIG. 17 is a perspective view showing an area of the air intake box in an enlarged manner.

As shown in FIG. 17, fixing portions 90 configured to fix a coupler connected to an electric wire is preferably provided on the surface of the air intake box 25. The fixing portion 90 preferably has a U-shape or a substantially U-shape inclined along the horizontal direction. The fixing portion 90, as a result of a coupler being inserted in the horizontal direction, fixes the coupler to the air intake box 25. Interference of the coupler with surrounding components and disconnection due to interference of the coupler is thus prevented. Because the fixing portions 90 are integrally and unitarily molded with the air intake box 25, the number of components, the assembling man-hours of the air intake box 25, and the costs are significantly reduced. Also, pulling the coupler out of the fixing portion 90 in the horizontal direction allows maintenance of the coupler to be easily performed.

Although preferred embodiments of the present invention have been described above, the present invention is not restricted to the contents of the preferred embodiments and various modifications are possible within the scope of the present invention.

Also, features of two or more of the various preferred embodiments described above may be combined.

The present application claims priority to Japanese Patent Application No. 2014-158128 filed on Aug. 1, 2014 in the Japan Patent Office, and the entire disclosure of which is incorporated herein by reference in its entirety.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vehicle comprising:

a body;

an engine mounted on the body;

an air intake box configured to supply air to the engine and opposed to the engine, the air intake box including an opposing surface opposed to the engine and a surface on which an electrical device is mounted that is different from the opposing surface;

a mounting portion provided on the air intake box and to which an electrical device is removably mounted, the mounting portion configured such that the electrical device is removably mounted without using an implement; and a positioning portion that is located at a rear end of the mounting portion and that positions the electrical device; wherein the mounting portion has a convex or substantially convex shape projecting from a surface of the air intake box, and a tubular portion into which nothing is inserted;

the electrical device includes a bracket including a hole into which the mounting portion is inserted;

the mounting portion inserted into the hole includes a distal end portion extending out of the hole;

a catching portion in the distal end portion is configured to be caught on a portion bordering the hole in the bracket; and the positioning portion is thicker in a direction orthogonal to an insertion direction in which the mounting portion is inserted into the hole than a forward portion of the mounting portion other than the distal end portion, the forward portion being farther forward in the insertion direction than the positioning portion.

2. The vehicle according to claim 1, wherein the vehicle is a jet propelled watercraft including a watercraft body including an opening portion that opens upward and a jet pump configured to generate a jet thrust by sucking in and ejecting water by a driving force of the engine;

the engine is accommodated in the watercraft body under the opening portion; and the surface to which the electrical device is mounted is different from both the opposing surface and a lower surface of the air intake box.

3. The vehicle according to claim 1, wherein the electrical device is mounted on an upper portion of the air intake box.

4. The vehicle according to claim 1, wherein the engine includes a crankshaft configured to rotate about a crank axis, and the air intake box is disposed on the crank axis.

5. The vehicle according to claim 1, wherein the air intake box is mounted on the engine.

6. The vehicle according to claim 5, wherein the air intake box is mounted on the engine via a vibration-proof member.

7. The vehicle according to claim 1, wherein the bracket is made of a vibration-proof material.

8. A jet propelled watercraft comprising:

a watercraft body;

an engine including a crankshaft configured to rotate about a crank axis extending in a longitudinal direction of the watercraft body, and accommodated in the watercraft body;

a jet pump configured to generate a jet thrust by sucking in and ejecting water by a driving force of the engine; and an air intake box configured to supply air to the engine, aligned with the engine on the crank axis, and including an opposing surface opposed to the engine and a surface on which an electrical device is mounted that is different from the opposing surface; wherein the air intake box includes a mounting portion to which the electrical device is mounted, and a positioning portion that is located at a rear end of the mounting portion and that positions the electrical device;

the mounting portion has a convex or substantially convex shape projecting from a surface of the air intake box, and a tubular portion into which nothing is inserted;

the electrical device includes a bracket including a hole into which the mounting portion is inserted;

the mounting portion inserted into the hole includes a distal end portion extending out of the hole;

a catching portion in the distal end portion is configured to be caught on a portion bordering the hole in the bracket; and the positioning portion is thicker in a direction orthogonal to an insertion direction in which the mounting portion is inserted into the hole than a forward portion of the mounting portion other than the distal end portion, the forward portion being farther forward in the insertion direction than the positioning portion.

9. The jet propelled watercraft according to claim 8, wherein the watercraft body includes an opening portion that opens upward;

the engine is accommodated in the watercraft body under the opening portion; and the surface on which the electrical device is mounted is different from the opposing surface and a lower surface of the air intake box.

10. The jet propelled watercraft according to claim 8, wherein the electrical device is mounted on an upper portion of the air intake box.

11. The jet propelled watercraft according to claim 8, wherein the air intake box is mounted on the engine via a vibration-proof member.

12. The jet propelled watercraft according to claim 8, wherein the mounting portion is configured such that the electrical device is removably mounted on the mounting portion.

13. An engine unit comprising:

an engine;

an air intake box mounted on the engine via a vibration-proof member, configured to supply air to the engine, and including an opposing surface opposed to the engine and a surface on which an electrical device is mounted that is different from the opposing surface;

a mounting portion provided on the air intake box and on which the electrical device is removably mounted;

a positioning portion that is located at a rear end of the mounting portion and that positions the electrical device; and an intake pipe connecting an intake-air outlet of the air intake box and an intake-air inlet of the engine to each other, and at least a portion of the intake pipe is made of a flexible material; wherein the mounting portion has a convex or substantially convex shape projecting from a surface of the air intake box, and a tubular portion into which nothing is inserted;

the electrical device includes a bracket including a hole into which the mounting portion is inserted;

the mounting portion inserted into the hole includes a distal end portion extending out of the hole;

a catching portion in the distal end portion is configured to be caught on a portion bordering the hole in the bracket; and the positioning portion is thicker in a direction orthogonal to an insertion direction in which the mounting portion is inserted into the hole than a forward portion of the mounting portion other than the distal end portion, the forward portion being farther forward in the insertion direction than the positioning portion.

14. The engine unit according to claim 13, wherein the surface on which the electrical device is mounted is different from both the opposing surface and a lower surface of the air intake box.

15. The engine unit according to claim 13, wherein the engine includes a crankshaft configured to rotate about a crank axis, and the air intake box is disposed on the crank axis.

* * * * *